US009193079B2

(12) United States Patent
Howell et al.

(10) Patent No.: US 9,193,079 B2
(45) Date of Patent: Nov. 24, 2015

(54) LINKAGE MECHANISM FOR A RAZOR

(75) Inventors: Daren Mark Howell, Winchester (GB); Ian Anthony Goodhead, Burton on Trent (GB); Terence Gordon Royle, Basingstoke (GB)

(73) Assignee: The Gillette Company, Boston, MA (US)

( * ) Notice: Subject to any disclaimer, the term of this patent is extended or adjusted under 35 U.S.C. 154(b) by 455 days.

(21) Appl. No.: 13/335,336

(22) Filed: Dec. 22, 2011

(65) Prior Publication Data

US 2013/0160305 A1 Jun. 27, 2013

(51) Int. Cl.
*B26B 21/22* (2006.01)
*B26B 21/52* (2006.01)

(52) U.S. Cl.
CPC ..... *B26B 21/225* (2013.01); *B26B 21/52* (2013.01); *B26B 21/521* (2013.01)

(58) Field of Classification Search
CPC .... B26B 21/52; B26B 21/521; B26B 21/525; B26B 21/225; B26B 19/046; B26B 19/048
USPC ..... 30/50, 51, 57, 58, 527, 526, 528, 538
See application file for complete search history.

(56) References Cited

U.S. PATENT DOCUMENTS

| | | | | |
|---|---|---|---|---|
| 3,950,848 | A | 4/1976 | Goldstein | |
| 5,533,236 | A * | 7/1996 | Tseng | 24/67.5 |
| 5,535,518 | A * | 7/1996 | Althaus | 30/527 |
| 5,661,907 | A | 9/1997 | Apprille, Jr. | |
| 5,787,586 | A | 8/1998 | Apprille, Jr. et al. | |
| 6,115,924 | A | 9/2000 | Oldroyd | |
| 6,557,265 | B2 | 5/2003 | Coffin | |
| 6,560,881 | B2 * | 5/2003 | Coffin | 30/531 |
| 7,137,205 | B2 * | 11/2006 | Royle | 30/527 |
| 7,168,173 | B2 | 1/2007 | Worrick, III | |
| 7,197,825 | B2 | 4/2007 | Walker et al. | |
| 2002/0116831 | A1 * | 8/2002 | Coffin | 30/526 |
| 2003/0079348 | A1 * | 5/2003 | Follo | 30/50 |
| 2005/0198843 | A1 | 9/2005 | Royle | |
| 2012/0210586 | A1 | 8/2012 | Lelieveld et al. | |

FOREIGN PATENT DOCUMENTS

| | | | | |
|---|---|---|---|---|
| GB | 1460732 A | * | 1/1977 | |
| GB | 2266070 A | * | 10/1993 | B26B 19/04 |
| WO | 97/19790 A1 | | 6/1997 | |

OTHER PUBLICATIONS

PCT Search Report and Written Opinion dated Feb. 15, 2013.

* cited by examiner

*Primary Examiner* — Ned Landrum
*Assistant Examiner* — Jennifer Swinney
(74) *Attorney, Agent, or Firm* — Ronald T. Sia; Kevin C. Johnson; Steven W. Miller

(57) ABSTRACT

A linkage mechanism for a wet shaving razor is provided. The linkage mechanism is pivotally connected to and suspended from the handle at one end and pivotally and removably attached to the cartridge carrier at an opposite end allowing the cartridge carrier to pivot about a virtual pivot axis located below the shaving plane and into the skin. The linkage mechanism provides flexibility in positioning the virtual pivot axis since it is not limited to the physical constraints of the cartridge. As a result, the shaving razor cartridge has a flatter contact with the skin throughout the shaving stroke providing shaving comfort with reduced nicks and cuts.

3 Claims, 26 Drawing Sheets

LINKAGE MECHANISM FOR A RAZOR

FIELD OF THE INVENTION

The present invention relates to shaving razors and particularly to shaving razor designs that provide users with improved control and closeness during shaving. Particularly, the shaving razor includes a linkage mechanism pivotally connected to and suspended from the handle at one end and pivotably connected and joined to a cartridge carrier at an opposite end. The cartridge carrier removably attaches to a razor cartridge and the linkage mechanism enables the razor cartridge to rotate about a virtual pivot axis located below the shaving surface and into the skin.

BACKGROUND OF THE INVENTION

This invention relates to a wet shaving razor comprising a cartridge that includes a shaving blade with a cutting edge which is moved across the surface of the skin being shaved by means of an adjoining handle. Conventional safety razors have a blade unit connected to a handle for a pivotal movement about a pivot axis which is substantially parallel to the blade or the blade edge. For example, U.S. Pat. Nos. 7,197,825 and 5,787,586 disclose such a razor having a blade unit capable of a pivotal movement about a pivot axis substantially parallel to the blade(s). The pivotal movement about the single axis provides some degree of conformance with the skin allowing the blade unit to follow the skin contours of a user during shaving. Such safety razors have been successfully marketed for many years. However, the blade unit can fail to remain flat and often disengages from the skin during shaving due to the blade unit's limited ability to pivot about the single axis combined with the dexterity required to control and maneuver the razor handle. The combination of these deficiencies can affect the glide and overall comfort during shaving.

There have been various proposals for mounting a cartridge on a handle to enable movement of the cartridge during shaving with the aim of maintaining conformity of the skin contacting parts of the cartridge with the skin surface during shaving. For example, many currently marketed razors include pivoting mechanisms which enable the cartridges to remain flat throughout the shaving stroke by providing a pivot axis in the center of the cartridge extending parallel to the cutting edges of the elongate blades incorporated in the cartridge. A razor including pivot axis 3 in the center of the cartridge 20 is illustrated in FIG. 1B. As shown in FIG. 1B, as the centrally pivoted cartridge approaches a bump in the skin 2, the blades 16 are compressed into the skin 2 increasing the risk of nicks and cuts which can potentially impact product safety. As a result, pivoting razor cartridges have progressed to forward pivot axis cartridges as illustrated in FIG. 1A having the pivot axis 3 beneath the guard 15 in order to produce a guard heavy cartridge 20. As the forward pivoting razor cartridge traverses the bump shown in FIG. 1A, the blades 16 are free to rotate away from the skin 2 reducing the risk of nicks and cuts. However, the forward pivoting cartridge has its drawbacks in that the guard heavy cartridge impacts the contact that the cartridge makes with the skin as well as the corresponding pressure distribution both of which are important to shaving efficacy and feel.

Throughout the development of razors, the cartridge to skin angle, or CTSA, has been a key measure to better understand contact between the cartridge and the skin. As illustrated in FIG. 1C, CTSA is the angle $\alpha$ between the skin tangent line 4 and the cutting plane 6 which is tangent to the guard 15 and cap 18. A flat CTSA $\alpha$ is desired for optimal cartridge to skin contact and pressure distribution throughout the shaving stroke.

Studies have revealed that CTSA is dependent on the cartridge pivot axis location. It has been found that designing a shaving razor cartridge that can pivot about virtual pivot axis located below the shaving plane and into the skin can provide a flat cartridge to skin angle throughout a shaving stroke. However, pivoting mechanisms are often restricted by the constraints of the cartridge which limit the capability for providing a desirable virtual pivot axis location. For instance, shell bearings are a commonly used pivot mechanism in razor design known to produce virtual pivot axis. An example of a shell bearing capable of producing a virtual pivot axis is disclosed in U.S. Pat. No. 5,661,907. However, shell bearings can rattle and bind leading to poor functionality and a low quality feel. These characteristics are extenuated as the radius of the shell is increased which is also limited to the constraints of the cartridge. Therefore, shell bearings are somewhat limited in their ability to produce virtual pivot axis. Thus, there is a need for a pivoting mechanism for a wet shaving razor capable of producing an optimal virtual pivot axis location that can maintain a flat CTSA throughout the shaving stroke with minimal nicks and cuts. There is also a need for a pivoting mechanism for a wet shaving razor capable of producing an optimal virtual pivot axis location that is not limited to the physical boundaries of the cartridge.

SUMMARY OF THE INVENTION

In one aspect, the invention features, in general, a linkage mechanism for a wet shaving razor including a cartridge carry one or more blades and a handle connected to the cartridge via the linkage mechanism. The linkage mechanism is pivotally connected to and suspended from the handle at one end and pivotably connected to and joined to the cartridge at an opposite end allowing the cartridge to pivot about a virtual pivot axis below the shaving surface and into the skin. As a result, the cartridge has a flatter contact with the skin throughout the shaving stroke. The cartridge can be directly, removably connected to the linkage mechanism or indirectly, removably connected to the linkage mechanism via a cartridge carrier providing a docking mechanism which is pivotally connected to the linkage mechanism. The linkage mechanism offers a flexible design which is not limited to the physical constraints of the cartridge and as a result is capable of producing a variety of desirable virtual pivot axis locations. In addition since the linkage mechanism is suspended from the handle at one end, it can be made to fit most standard razor handles requiring minimal modifications to the handle design.

The linkage mechanism comprises two longitudinal links each pivotally connected to the cartridge at one end and pivotally interconnected with two transverse links at another end. The two transverse links are pivotally connected to and suspended from the handle. A first longitudinal link has a first end and a second end opposite the first end. The first longitudinal link first end is pivotally attached to the cartridge at a first pivot axis. A second longitudinal link has a first end and a second end opposite the first end. The second longitudinal link first end is pivotally attached to the cartridge at a second pivot axis. The first transverse link has a first end and a second end opposite the first end. The first transverse link first end is pivotally attached to the handle at a third pivot axis and the first transverse link second end is pivotally attached to at least one of the first longitudinal link second end at a fourth pivot axis and the second longitudinal link second end at a fifth pivot axis. The second transverse link has a first end and a second end opposite the first end. The second transverse link first end is pivotally attached to the handle at a sixth pivot axis and the second transverse link second end is pivotally attached to at least one of the first longitudinal link at a seventh pivot axis and the second longitudinal link at an eighth pivot axis. At least one of the first transverse link or the second transverse link is pivotally attached to both the first longitudinal link and the second longitudinal link at the aforementioned pivot axes locations. The first or second transverse link that is not pivotally attached to both the first and second longitudinal links is pivotally attached to at least one of the first or second longitudinal links at the corresponding pivot axes locations identified above. Alternatively, both the first transverse link and the second transverse link are pivotally attached to both the first and second longitudinal links.

The virtual pivot axis produced by the linkage mechanism is below the shaving surface and into the skin. The actual location is separated from the first and second pivot axes on the cartridge by distances corresponding to the distances separating the pivot axes interconnecting the longitudinal and transverse links with the handle. For instance, the distance between the fourth pivot axis and the third pivot axis is a third distance and the distance between the fifth pivot axis and the third pivot axis is a fourth distance. The distance between the seventh pivot axis and the sixth pivot axis is a sixth distance equal to the third distance and the distance between the eighth pivot axis and the sixth pivot axis is a seventh distance equal to the fourth distance. As a result, the virtual pivot axis is separated from the first pivot axis by an eighth distance equal to the third distance and from the second pivot axis by ninth distance equal to the fourth distance.

In one embodiment of the aforementioned linkage mechanism, the first transverse link second end is pivotally attached to the first longitudinal link second end at the fourth pivot axis and to the second longitudinal link second end at the fifth pivot axis. For this embodiment the second transverse link second end can be pivotally connected to either the first longitudinal link at the seventh pivot axis or the second longitudinal link at the eighth pivot axis.

In another embodiment of the aforementioned linkage mechanism, the second transverse link is pivotally attached to the first longitudinal link second end at the seventh pivot axis and pivotally attached to the second longitudinal link at the eighth pivot axis. For this embodiment the first transverse link second end can be pivotally attached to the first longitudinal link at the fourth pivot axis or pivotally attached to the second longitudinal link at the fifth pivot axis.

In another embodiment of the aforementioned linkage mechanism, the first transverse link second end is pivotally attached to the first longitudinal link second end at the fourth pivot axis and to the second longitudinal link second end at the fifth pivot axis. For this embodiment, the second transverse link second end is pivotally attached to the first longitudinal link at the seventh pivot axis and pivotally attached to the second longitudinal link at the eighth pivot axis.

In an alternate embodiment, the linkage mechanism includes two longitudinal links each pivotally connected to the cartridge at one end and pivotally interconnected with four transverse links on opposite sides of the longitudinal links at the other end. Each of the four transverse links can be connected to one or both of the two longitudinal links. In one embodiment, the first transverse link first end is pivotally attached to the handle at the third pivot axis and the second end is pivotally attached to a first side of the first longitudinal link at the fourth pivot axis. The second transverse link first end is pivotally attached to the handle at the sixth pivot axis and the second transverse link second end is pivotally attached to a first side of the second longitudinal link at the eighth pivot axis. The linkage mechanism further comprises a third transverse link having a first end and a second end and a fourth transverse link having a first end and a second end. The third transverse link first end is pivotally attached to the handle at the third pivot axis opposite the first transverse link first end and the third transverse link second end is pivotally attached to a second side of the second longitudinal link at the fifth pivot axis. The fourth transverse link first end is pivotally attached to the handle at the sixth pivot axis opposite the second transverse link first end and the fourth transverse link second end is pivotally attached to a second side of the first longitudinal link at the seventh pivot axis. The first transverse link and the fourth transverse link are parallel and pivotally attached to opposite sides of the first longitudinal link and the second transverse link and the third transverse link are parallel and pivotally attached to opposite sides of the second longitudinal link. In an alternate embodiment of the linkage mechanism comprising four transverse links, the second and fourth transverse links are changed such that the second transverse link second end is pivotally attached to the first longitudinal link first side at the seventh pivot axis, and the fourth transverse link second end is pivotally attached to the second longitudinal link second side at the eighth pivot axis. In this embodiment, the first transverse link and the second transverse link are parallel and pivotally attached to the first side of the first longitudinal link and the third transverse link and the fourth transverse link are parallel and pivotally attached to the second side of the second longitudinal link.

In another embodiment the linkage mechanism comprises four longitudinal links each pivotally connected to the cartridge at one end and pivotally interconnected with one of two transverse links at another end allowing the cartridge to pivot about a virtual pivot axis below the shaving surface. The two transverse links are pivotally connected to and suspended from the handle. A first end of the first longitudinal link is pivotally attached to the cartridge at a first pivot axis. A first end of the second longitudinal link is pivotally attached to the cartridge at a second pivot axis. A first end of the third longitudinal link is pivotally attached to the cartridge at the first pivot axis opposite the first longitudinal link first end. And a first end of the fourth longitudinal link is pivotally attached to the cartridge at the second pivot axis opposite the second longitudinal link second end. The first transverse link has a first end pivotally attached to the handle at a third pivot axis and a second end pivotally attached to a second end of the first longitudinal link at a fourth pivot axis and to a second end of the second longitudinal link at a fifth pivot axis. The second transverse link has a first end pivotally attached to the handle at a sixth pivot axis and a second end pivotally attached to a second end of third longitudinal link at a seventh pivot axis and to a second end of the fourth longitudinal link at an eighth pivot axis. The linkage mechanism causes the cartridge to rotate about a virtual pivot axis which is separated from the first pivot axis by a distance equal to the distance between the third and fourth pivot axis and separated from the second pivot axis by a distance equal to the distance separating the third and fifth pivot axis.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

The shaving razor according to the present invention will be described with reference to the following figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

Figure 1A:
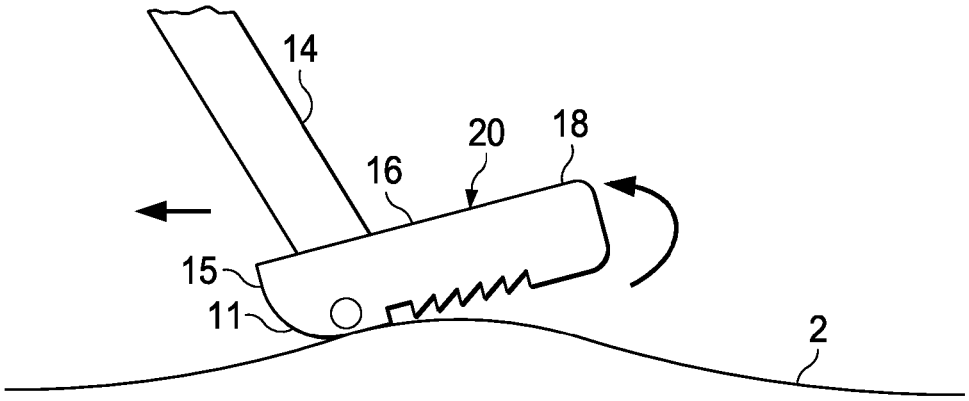
FIG. 1A (PRIOR ART)
FIG. 1A is a side view of a prior art razor cartridge and handle configuration.
Figure 1B:
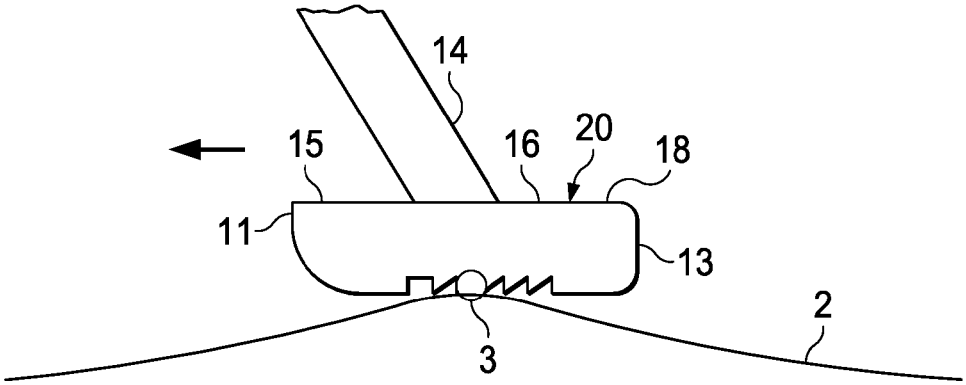
FIG. 1B (PRIOR ART)
FIG. 1B is a side view of a prior art razor cartridge and handle configuration.
Figure 1C:
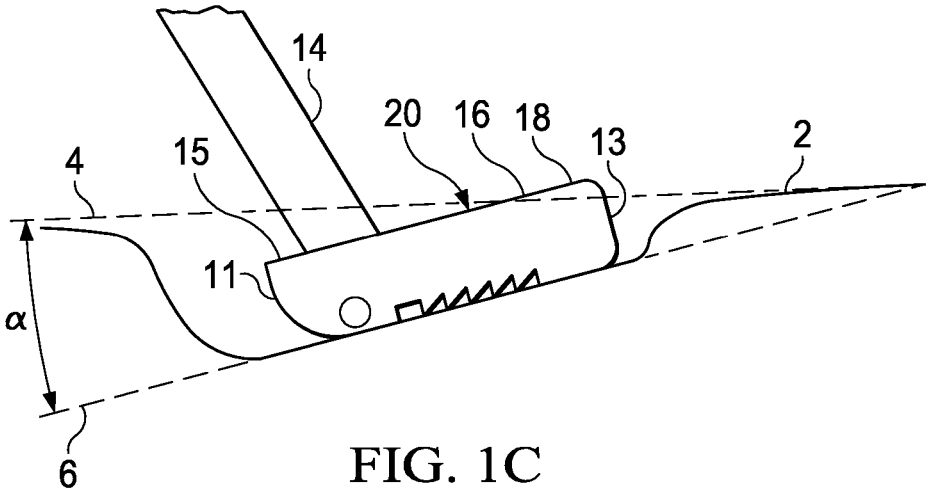
FIG. 1C (PRIOR ART)
Figure 2A:
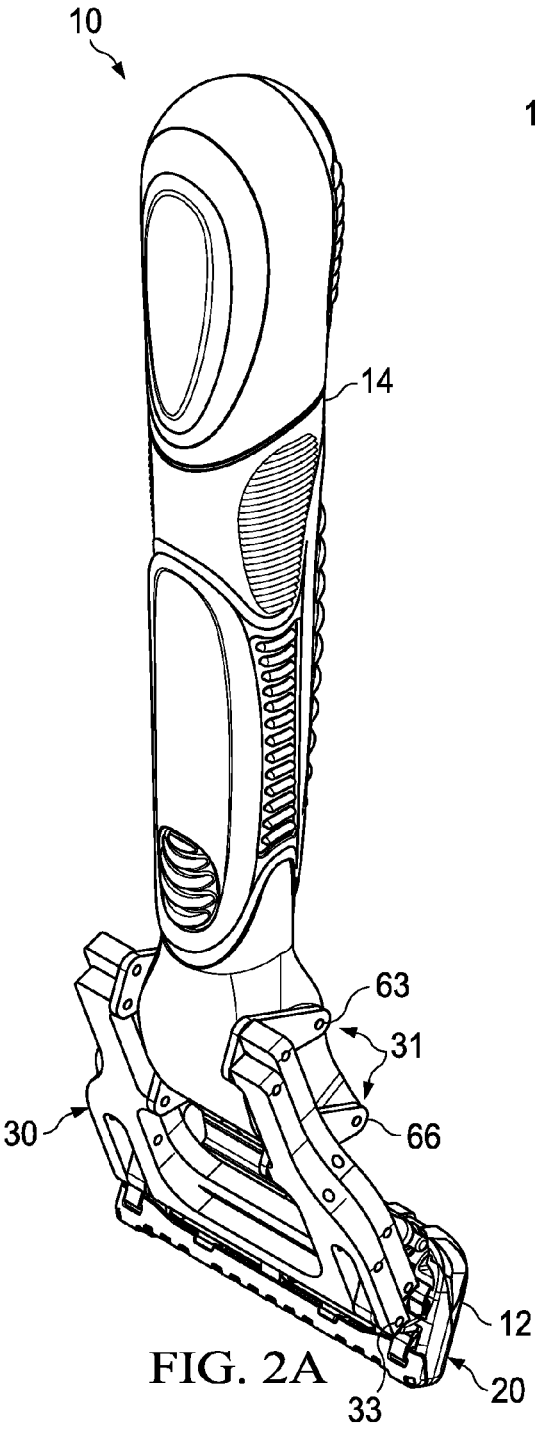
FIG. 2A is a perspective view of a shaving razor.
Figure 2B:
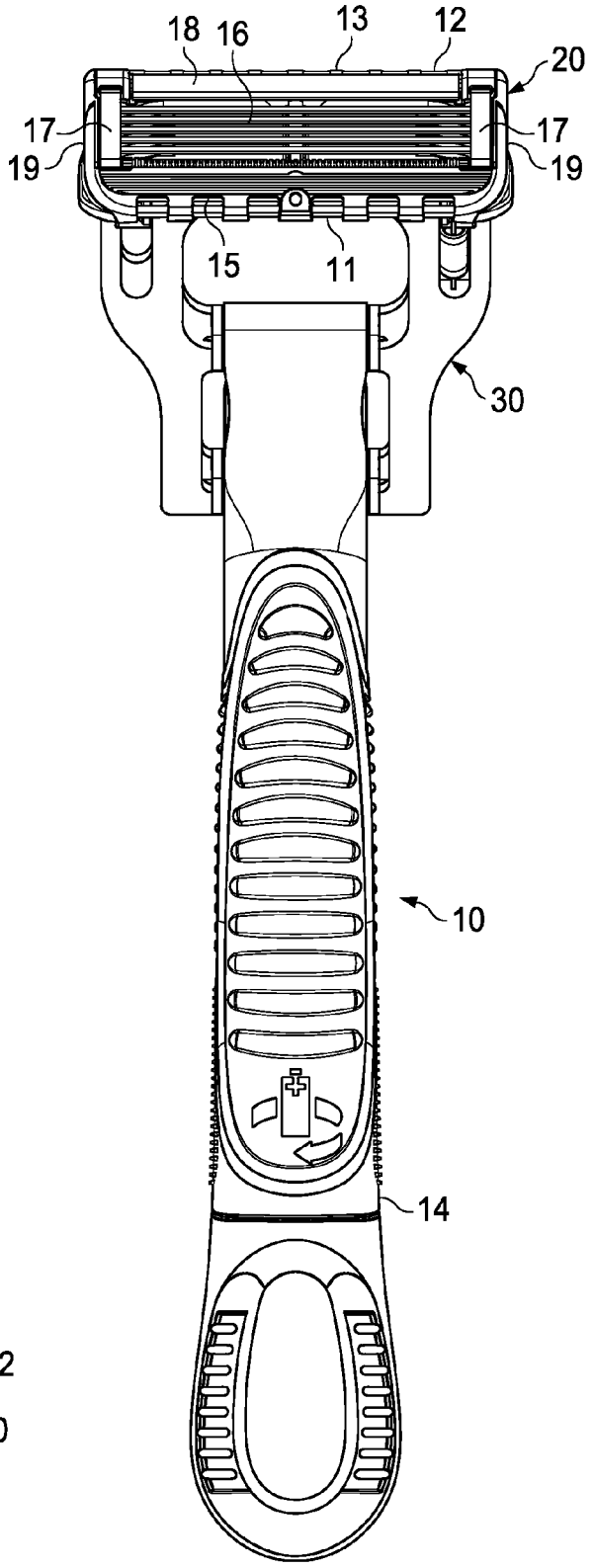
FIG. 2B is a bottom view of a shaving razor.

Referring to FIG. 2A and FIG. 2B, the shaving razor 10 includes disposable cartridge 20 and handle 14. The disposable cartridge 20 comprises a blade unit that includes a plastic housing 12, a guard 15 at a front edge portion 11 of the housing 12 and a cap 18 at a rear edge portion 13 of the housing 12. The guard 15 may have a plurality of fins spaced apart from each other that extend longitudinally along a length of the housing 12. The cap 18 may have a lubricating strip. Two opposing side edge portions 19 extend between the front edge portion 11 and the rear edge portion 13. One or more elongated shaving blades 16 are positioned between the guard 15 and cap 18. Although five shaving blades 16 are shown, it is understood that more or less shaving blades 16 may be mounted within the housing 12. The blades 16 are shown secured within the housing 12 with clips 17; however, other assembly methods known to those skilled in the art may also be used. These and other features of shaving razor 10 are described in U.S. Pat. No. 7,168,173.

Figure 4:
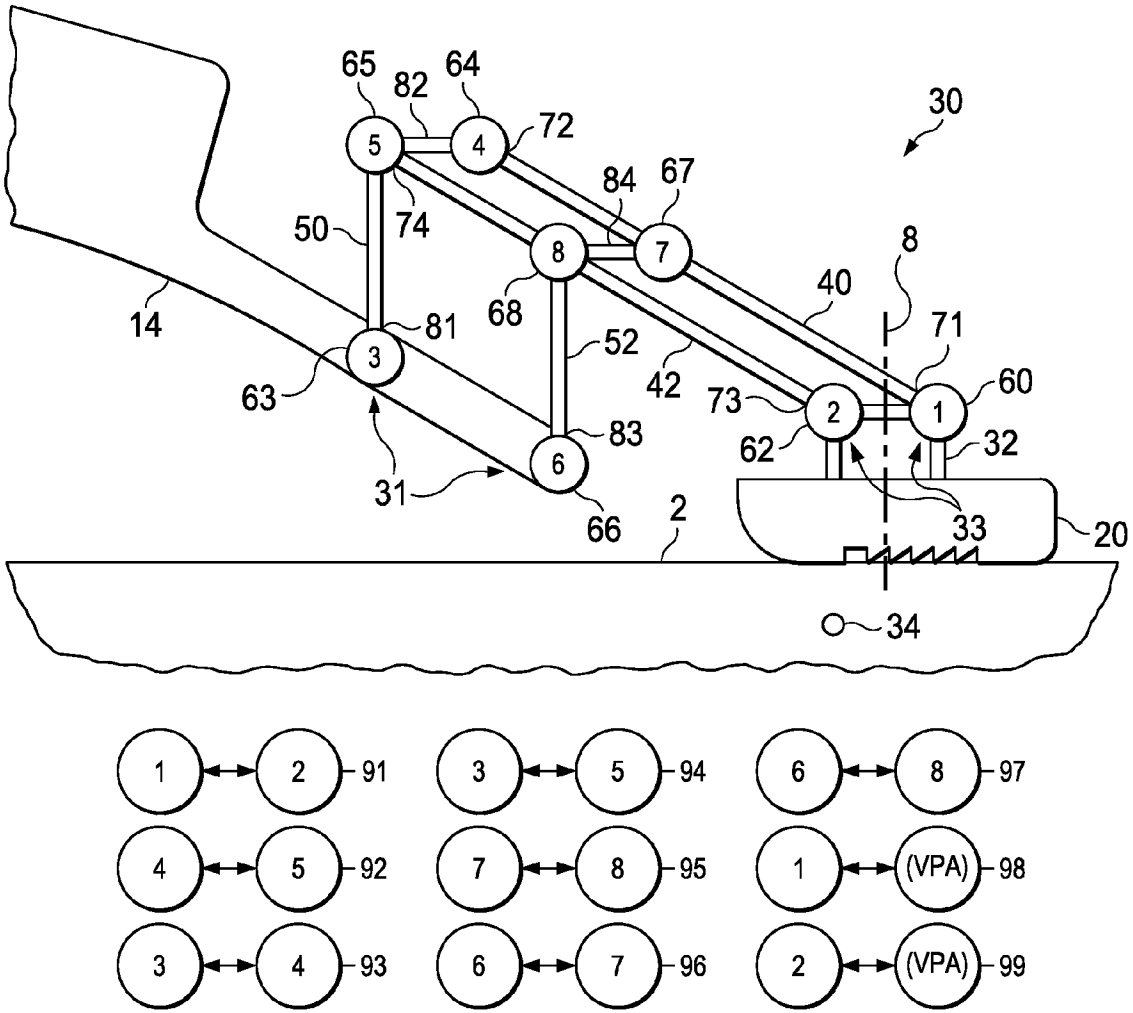
FIG. 4 is a side view of a razor linkage mechanism which is a simplified version of the razor linkage mechanism shown in FIG. 3A.

The razor 10 includes a linkage mechanism 30, which connects the cartridge 20 to a handle 14. Examples of linkage mechanisms are disclosed in U.S. Pat. No. 7,137,205. The linkage mechanism 30 is pivotally connected to the handle 14 at one end and pivotably connected to the cartridge 20 at an opposite end. Preferably, the linkage mechanism according to the present invention is pivotally connected to and suspended from the handle at one end and pivotally and removably connected to the cartridge 20 at the opposite end. As used herein, the phrase "suspended from the handle" means that linkage mechanism is free on all sides except at the point of support where one end of the linkage mechanism is pivotally connected to the handle. In other words the linkage mechanism is in effect cantilevered from the handle such that one end is supported on the handle and the opposite end which is connected to the cartridge is projected from the handle via the linkage mechanism. For instance, for the razor 10 shown in FIG. 2A, the linkage member 30 includes a first end 31 pivotally connected to the handle 14 and a second end 33 pivotally connected to the cartridge 20. As shown the linkage mechanism 30 is free on all sides except the point of support where the linkage mechanism first end 31 is pivotally attached to the handle at two pivot axes, third pivot axis 63 and sixth pivot axis 66, both of which are fully described below. Alternately, the linkage mechanism second end 33 can be pivotally connected to a cartridge carrier 32 at the second end 33 which in turn is removably connected to the cartridge 20 as shown in FIG. 4. The cartridge carrier 32 includes a docking structure for removably connecting the cartridge carrier to the cartridge. Razor cartridge docking structures are disclosed in U.S. Pat. No. 5,787,586 and U.S. Pat. No. 7,168,173. As shown in FIG. 4, the linkage member first end 31 is pivotally connected to the handle 14 at the third and sixth pivot axis 63 and 66 and cantilevered such that the second end 33 is projected from the handle 14 and pivotally connected to the cartridge carrier at pivot axis 60 and 62.

The linkage mechanism according to the present invention comprises linkage members pivotally interconnected via pivot axes. The pivot axes can comprise pins, rods, bushings, or live hinges. Live hinges include thin film or thin plastic hinges molded in between the linkage members.

Figure 2C:
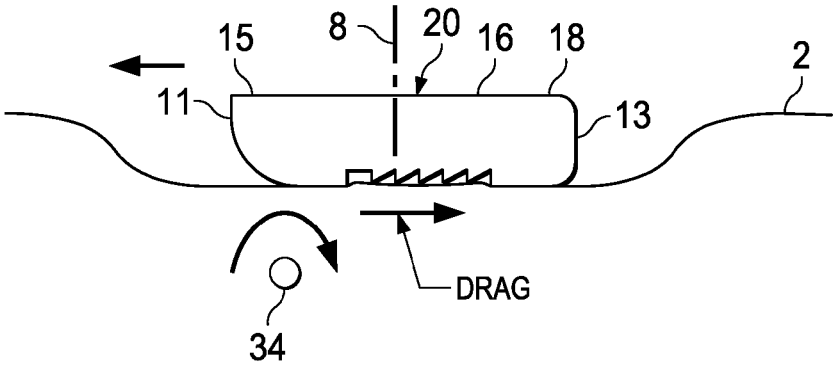
FIG. 2C is a side view of a razor cartridge illustrating a virtual pivot axis location.

The linkage mechanism for the wet shaving razor according to the present invention is a pivoting mechanism capable of producing a virtual pivot axis. A virtual pivot axis is a line in space about which an object rotates. For the present invention, the object is the razor cartridge 20 shown in FIG. 2C and the virtual pivot axis 34 is forward of a cartridge midpoint 8 which is located between the front edge 11 and the rear edge 13 of the cartridge. The virtual pivot axis 34 may be located on, above or even into the skin 2 as shown in FIG. 2C depending on the arrangement and dimensions of the linkage mechanism components. Preferably the linkage mechanism according to the present invention produces a virtual pivot axis 34 in a region that is forward of the cartridge midpoint 8 toward the front edge 11 of the cartridge 20 and below the cutting plane 6 into the skin 2. During a shaving stroke, a cartridge having a virtual pivot axis 34 located in this region enables the guard 15 at the front edge 11 of the cartridge 20 to rotate away from the contours of the skin 2 and the cap 18 positioned near the rear edge 13 of the cartridge 20 to rotate into the skin 2 as illustrated in FIG. 2C. The preferred location of the virtual pivot axis region is fully described below.

Other pivoting mechanisms such as shell bearings are also capable of producing virtual pivot axis within the region described above; however, the size of shell bearings are typically confined to the physical constraints of the cartridge which limits the region where the virtual pivot axis can be produced. An example of a razor incorporating shell bearings capable of producing a virtual pivot axis is disclosed in U.S. Pat. No. 5,661,907.

Figure 3A:
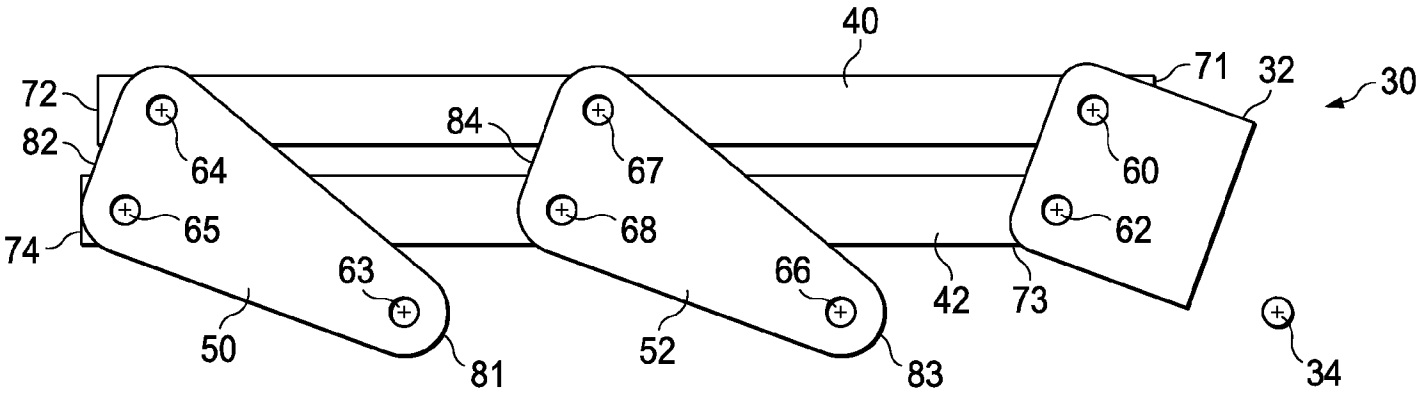
FIG. 3A is a side view of a razor linkage mechanism.

An asymmetric 4-bar linkage mechanism used to explore various virtual pivot axis locations for a razor is shown in FIG. 3A. The linkage mechanism 30 comprises two longitudinal links 40, 42 each pivotally connected to a cartridge carrier 32 at one end and pivotally interconnected with two transverse links 50, 52 at an opposite end. The two transverse links 50, 52 are each pivotally connected to the longitudinal links 40, 42 at one end and pivotally connected to and suspended from the handle 14 at an opposite end. For the embodiment shown in FIG. 3A, the longitudinal links 40, 42 comprise linear members and the transverse links 50, 52 are right triangles forming bell cranks pivoted where the two right sides of each of the triangles meet. When one side of the triangle is pulled, the triangle rotates around the pivot axis, pulling on the other side. The net effect is that the cartridge carrier 32 follows the same arc of rotation as the triangles forming the first and second transverse links 50, 52 causing it to pivot around a virtual pivot axis 34. The location of the virtual pivot axis 34 is determined by overlaying an imaginary third triangle over the cartridge that is the same size as the triangles forming the transverse links such that the pivot axes connecting the transverse links with the longitudinal links align with the two pivot axes on the cartridge carrier 32. As a result, the location of the virtual pivot axis 34 is largely defined by the size and shape of the transverse links 50, 52. For the first and second transverse links 50, 52 comprising right triangles shown in FIG. 3A, the virtual pivot axis is located near the forward end of the cartridge carrier 32. In an alternate embodiment shown in FIG. 3B, the transverse links 50, 52 comprise equilateral triangles producing a virtual pivot axis 34 location which is below the cartridge carrier 32 near the midpoint of the cartridge.

Although the shape of the transverse links is largely determined by the desired virtual pivot axis location, the shapes of the transverse links and the longitudinal links are also limited by the space available between the handle and the skin during a shaving stroke. While working within a desired space envelope, it is possible to introduce certain relationships between the first and second transverse links as well as the first and second longitudinal links. For instance, the unnecessary mass on the transverse links forming triangles can be removed forming L-shaped transverse links permitting the transverse links to tessellate when rocking forward and aft allowing the links to be positioned closer together. A four bar linkage mechanism comprising first and second L-shaped transverse links 50, 52 and linear first and second longitudinal links 40, 42 is shown in FIG. 4. Angular kinks can also be introduced to the longitudinal links allowing for customization of the pivot axis locations on the handle and transverse links relative to the virtual pivot axis location. A variety of shapes and sizes for both the transverse and longitudinal links are discussed more fully below.

Figure 3B:
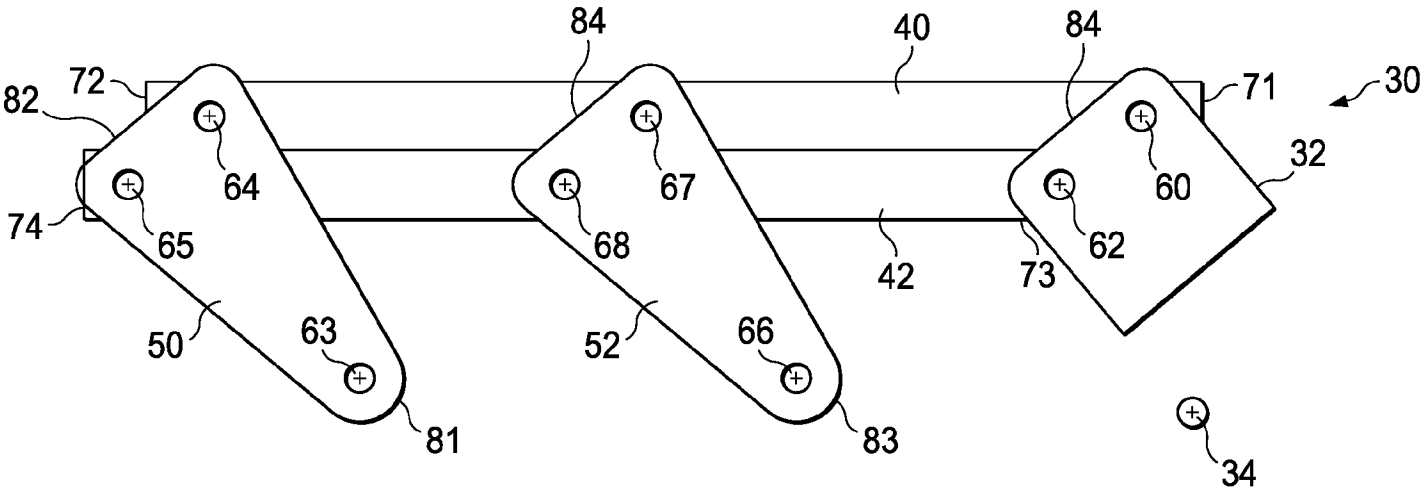
FIG. 3B is a side view of a razor linkage mechanism.

For the four bar linkage mechanisms shown in FIG. 3A, FIG. 3B and FIG. 4, the first longitudinal link 40 has a first end 71 and a second end 72 opposite the first end 71. The first longitudinal link first end 71 is pivotally attached to the cartridge carrier 32 at a first pivot axis 60. The second longitudinal link 42 has a first end 73 and a second end 74 opposite the first end 73. The second longitudinal link first end 73 is pivotally attached to the cartridge carrier 32 at a second pivot axis 62. The second pivot axis 62 is separated from the first pivot axis 60 by a first distance 91 shown in FIG. 4.

The first transverse link 50 has a first end 81 and a second end 82 opposite the first end 81. The first transverse link first end 81 is pivotally attached to the handle 14 at a third pivot axis 63 and the first transverse link second end 82 is pivotally attached to the first longitudinal link second end 72 at a fourth pivot axis 64 and the second longitudinal link second end 74 at a fifth pivot axis 65. The fourth pivot axis 64 is separated from the fifth pivot axis 65 by a second distance 92 equal to the first distance 91. The fourth pivot axis 64 is separated from the third pivot axis 63 by a third distance 93 and the fifth pivot axis 65 is separated from the third pivot axis 63 by a fourth distance 94.

The second transverse link 52 has a first end 83 and a second end 84 opposite the first end 83. The second transverse link first end 83 is pivotally attached to the handle 14 at a sixth pivot axis 66 and the second transverse link second end 84 is pivotally attached to the first longitudinal link 40 at a seventh pivot axis 67 and the second longitudinal link 42 at an eighth pivot axis 68. The seventh pivot axis 67 is separated from the eighth pivot axis 68 by a fifth distance 95 equal to the first distance 91. The distance between the seventh pivot axis 67 and the sixth pivot axis 66 is a sixth distance 96 equal to the third distance 93 and the distance between the eighth pivot axis 68 and the sixth pivot axis 66 is a seventh distance 97 equal to the fourth distance 94.

The corresponding linkage mechanism produces a virtual pivot axis 34 that is separated from the first pivot axis 60 by an eighth distance 98 equal to the third distance 93 and separated from the second pivot axis 62 by a ninth distance 99 equal to the fourth distance 94. As previously explained the virtual pivot axis is preferably located forward of the cartridge midpoint 8 and beneath the skin surface 2. In addition to relying on the configuration of the links forming the linkage mechanism to produce the desired virtual pivot axis location, the first and second pivot axis 60 and 62 are positioned in the cartridge carrier 32 relative to the cartridge midpoint 8 and the combined height of the cartridge carrier 32 and the cartridge 20. For instance, referring to FIG. 4 in order to provide a virtual pivot axis 34 location that is forward of the cartridge midpoint, the cartridge must be fixed to the cartridge carrier in relation to the cartridge midpoint 8, the cartridge carrier 32 and the design of the transverse links. As previously described, the location of the virtual pivot axis 34 is determined by overlaying an imaginary third triangle over the cartridge that is the same size as the triangles forming the transverse links such that the pivot axes connecting the transverse links with the longitudinal links align with the first and second pivot axes 60, 62 on the cartridge carrier 32. To achieve a virtual pivot axis 34 location that is forward of the cartridge midpoint 8, the cartridge 20 must be affixed to the cartridge carrier 32 so that the imaginary third triangle pivot axis which is not connected to the longitudinal links lies forward of the cartridge midpoint. In addition, in order to provide a virtual pivot axis 34 that is below the skin surface, the first and second pivot axis 60, 62 are located in the cartridge carrier 32 such that the distance between the second pivot axis 62 and the skin surface 2 is less than the fourth distance 94 separating the third and fifth pivot axis 63, 65 and the distance between the first pivot axis 60 and the skin surface 2 is less than the third distance 93 separating the third pivot axis 63 and the fourth pivot axis 64.

In this embodiment, it is possible to remove the cartridge 20 and the cartridge carrier 32 from the system such that the first and second pivot axis 60, 62 form part of the docking mechanism and the linkage mechanism will continue to function properly. As a result, the cartridge 20 and cartridge carrier 32 may be combined into a single part with the attachment/detachment of the cartridge located at the first and second pivot axis 60, 62.

The advantage of the four bar linkage system 30 previously described is that it offers customizability in terms of size and shape of the mechanism. The four bar linkage system 30 can be modified in various ways allowing the linkage mechanism 30 to be designed into a standard razor handle form with minimal disruption to the overall size and aesthetics while providing flexibility in producing a desirable virtual pivot axis location. For instance, the shape of the individual components of the linkage mechanism can be designed to accommodate a specific application desired both at rest and in motion and the dimensions of the linkage mechanisms can be changed to provide the desired location for the virtual pivot axis.

Figure 5A:
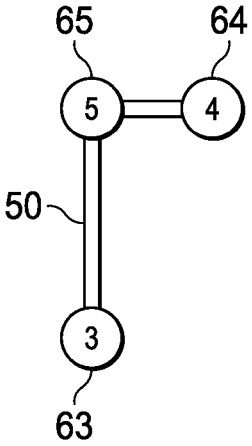
FIGS. 5*a*-5*d* are side views of transverse linkage member configurations used in razor linkage mechanisms.
Figure 5B:
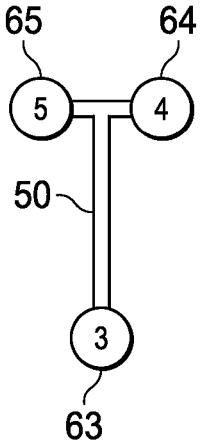

The main options for the transverse link shapes are shown in FIGS. 5*a* to 5*d*. Each of the transverse link layouts produces a slightly different pivot mechanism shape and size depending on the design intention. For instance, the shape of the first transverse link 50 shown in FIG. 5*a* is a right angle which is desirable for embodiments previously described where the virtual pivot axis is located beneath the cartridge in the guard area. The first transverse link 50 shape in FIG. 5*b* is an isosceles making the three pivot points into an isosceles triangle so the distance between the third pivot axis 63 and the fourth pivot axis 64 is equal to the distance between the third pivot axis 63 and the fifth pivot axis 65. An example of a linkage mechanism comprising isosceles triangle transverse links was previously described and illustrated in FIG. 3B. The isosceles design can help minimize the size of the mechanism and can create a symmetrical design shifting the virtual pivot axis closer to the center of the cartridge.

Figure 5C:
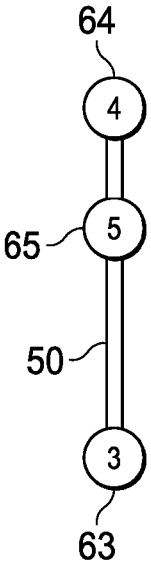

The first transverse link 50 shown in FIG. 5*c* is linear in shape. Making the three pivot axes 63, 64, 65 collinear makes the first transverse link 50 very narrow but tall which in some circumstances may allow for a more compact mechanism. A linkage mechanism incorporating the linear transverse links is shown in FIG. 6.

Figure 6:
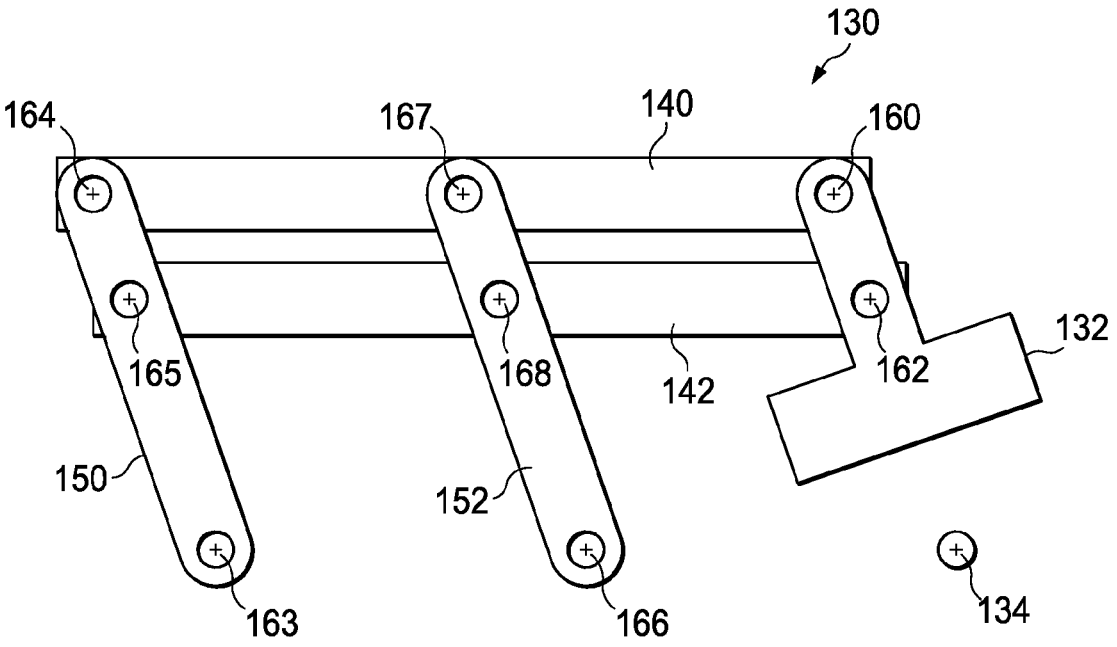
FIG. 6 is a side view a of a razor linkage mechanism including linear transverse links and linear longitudinal links.

As shown in FIG. 6, the four bar linkage mechanism 130 comprises a first linear transverse link 150 and a second linear transverse link 152 interconnected with a first longitudinal link 140 and a second longitudinal link 142. The first and second longitudinal links are connected to the cartridge carrier 132 at the first pivot axis 160 and the second pivot axis 162, respectively. The third pivot axis 163, fourth pivot axis 164, and fifth pivot axis 165 on the first linear transverse link 150 are collinear and the sixth pivot axis 166, seventh pivot axis 167 and eighth pivot axis 168 on the second linear transverse link 152 are collinear. As shown in FIG. 6, since the linear transverse links 150, 152 are significantly reduced in width compared to the triangular and L-shaped transverse links previously described; the overall length of the linkage mechanism is reduced. However, since the distances between the third and fourth pivot axis 163, 164 on the first transverse link 150 and the sixth and seventh pivot axis 166, 167 on the second transverse link 152 are increased, the overall height of the mechanism 130 is increased.

Figure 5D:
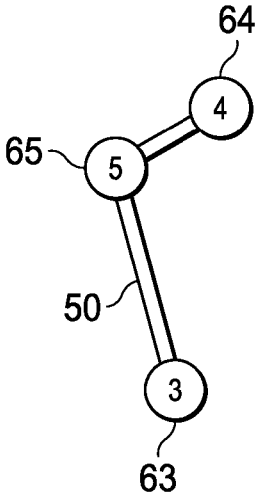

The first transverse link 50 shape shown in FIG. 5*d* is angled such that the pivot axes located at the ends of the first transverse links 50 (i.e. third pivot axis 63 and the fourth pivot axis 64) are separated by an angle about the middle pivot axis (i.e. the fifth pivot axis 65). The angular relationship between the end pivots can vary depending on the application. For instance, it may be necessary to make the transverse links as small as possible to fit in the space available. The angular relationship can range from 10 to 240 degrees but can comprise virtually any angle depending on the application.

Figure 7A:
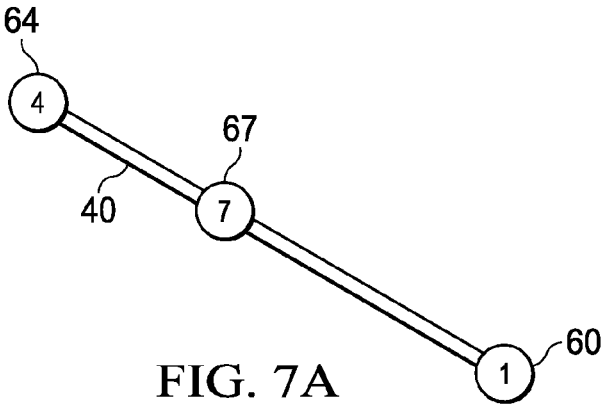
FIGS. 7*a*-7*d* are side views of longitudinal linkage member configurations used in razor linkage mechanisms.
Figure 7B:
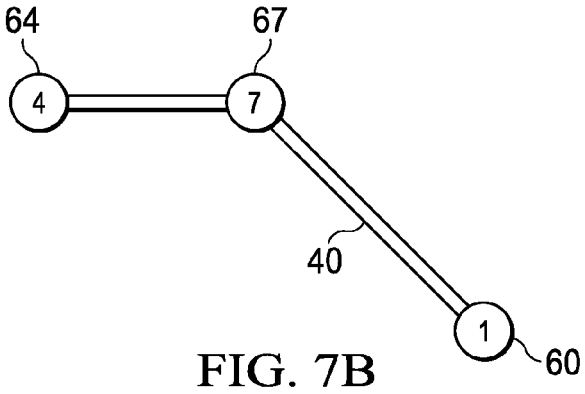
Figure 7C:
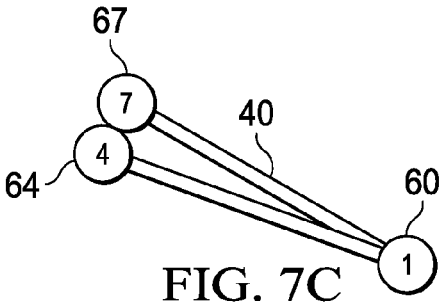
Figure 7D:
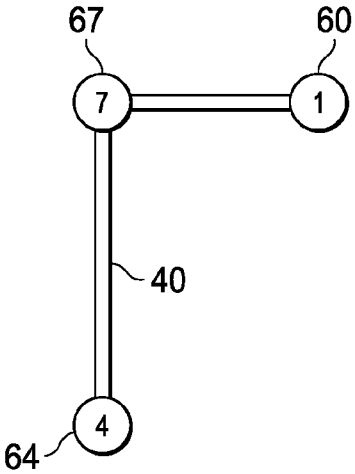

Similar to the transverse links, the longitudinal links can comprise a number of different shapes in order to accommodate a particular application. Examples of longitudinal link shapes are shown in FIGS. 7*a*-7*d*. Similar to the longitudinal links shown in FIG. 4, the first longitudinal link 40 shown in FIG. 7*a* is linear in shape such that the first pivot axis 60, the seventh pivot axis 67 and the fourth pivot axis are collinear. As shown in FIG. 4, the shape of the longitudinal links 40 is constrained by the desired position of the virtual pivot axis 34 relative to the third pivot axis 63 and the sixth pivot axis 66 attached to the handle 14. The linear longitudinal links 40 shown in FIG. 4 are simple to manufacture; however, longitudinal links having complex geometries are often desired particularly where space is an issue. Complex geometries for the first and second longitudinal links 40 include shapes such as an angled longitudinal link shape as shown in FIG. 7*b*, an isosceles triangle longitudinal link shape as shown in FIG. 7*c* and a right triangle longitudinal link shape as shown in FIG. 7*d*.

Figure 8:
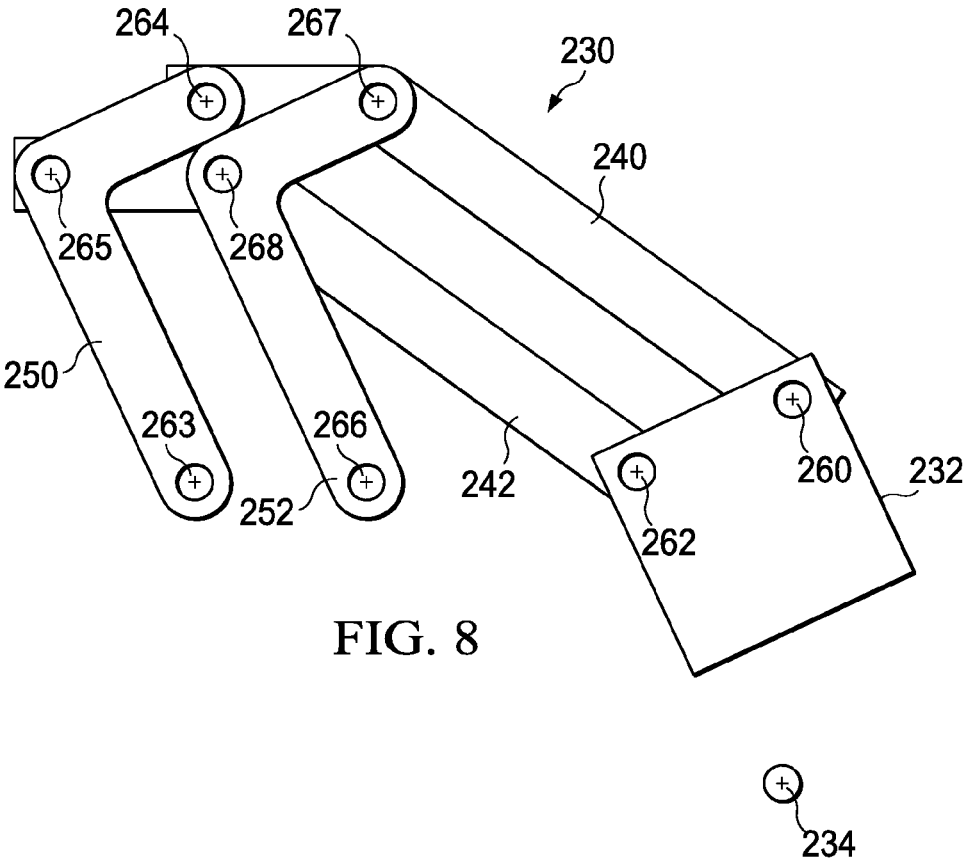
FIG. 8 is a side view of a linkage mechanism including the angled longitudinal links shown in FIG. 7*b*.

The angled longitudinal link 40 shown in FIG. 7*b* can be formed by introducing an angle about the seventh pivot axis 67 between the first pivot axis 60 and the fourth pivot axis 64 on the first longitudinal link 40 and about the eight pivot axis 68 between the second pivot axis 62 and the fifth pivot axis 65 on the second longitudinal link 42. Angled longitudinal links can result in a more compact linkage mechanism by allowing the longitudinal links to tessellate together better and provide more desirable pivot axes locations on the handle. For instance, if angled longitudinal links are applied to the linkage mechanism shown in FIG. 4, the result is the four bar linkage mechanism shown in FIG. 8 comprising angled first and second longitudinal links 240, 242 interconnected with the cartridge carrier 232 at the first and second pivot axes 260 and 262 at one end and interconnected with the right triangle shaped first and second transverse links 250, 252 at the other ends. The first transverse link 250 is pivotally connected to the handle at the third pivot axis 263, pivotally connected to the first longitudinal link 240 at the fourth pivot axis 264 and pivotally connected to the second longitudinal link 242 at the fifth pivot axis 265. The second transverse link 252 is pivotally connected to the handle at the sixth pivot axis 266, pivotally connected to the first longitudinal link 240 at the seventh pivot axis 267 and pivotally connected to the second longitudinal link 242 at the eighth pivot axis 268. As shown in FIG. 8, the angled first and second longitudinal links 240, 242 are able to tessellate closer together and the distance separating the virtual pivot axis 234 from the third pivot axis 263 and the sixth pivot axis 266 is increased resulting in more clearance between the handle and the shaving surface.

Figure 9:
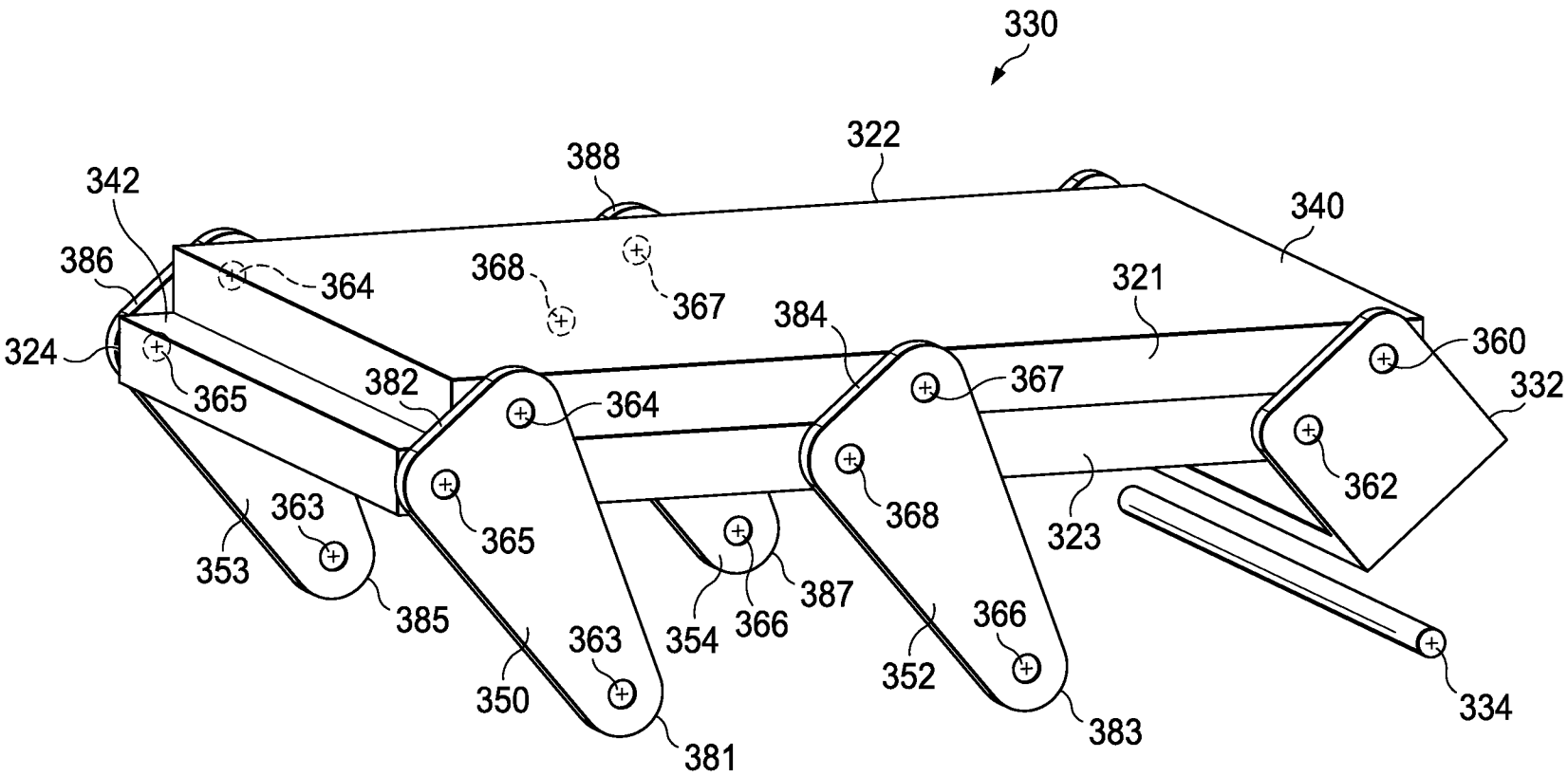
FIG. 9 is a perspective view of the linkage mechanism shown in FIG. 3A including two additional transverse links.

The suspended linkage mechanisms described thus far have been relatively simple, comprising symmetrical longitudinal and transverse links having minimal different parts. However, some applications require more complex linkage mechanisms in order to accommodate a desired virtual pivot axis for a specific razor configuration. The complex linkage mechanisms can require a larger total number of parts as well as a larger number of different parts making it more difficult to manufacture. An example of a linkage mechanism having an increase in the total number of parts is the mechanism shown in FIG. 9. Similar to the mechanism shown in FIG. 3B, the linkage mechanism includes two equilateral transverse links disposed one side of the first and second longitudinal links; however the linkage mechanism in FIG. 9 includes two additional equilateral transverse links disposed opposite the first two transverse links resulting in a total of four transverse links. As shown in FIG. 9, the first longitudinal link 340 includes a first side 321 and a second side 322 and the second longitudinal link 342 includes a first side 323 and a second side 324. The first transverse link second end 382 is pivotally attached to the first longitudinal link first side 321 at the fourth pivot axis 364 and the second longitudinal link first side 323 at the fifth pivot axis 365. The second transverse link second end 384 is pivotally attached to the first longitudinal link first side 321 at the seventh pivot axis 367 and to the second longitudinal link first side 323 at the eighth pivot axis 368. A third transverse link first end 385 is pivotally attached to the handle at the third pivot axis 363 opposite the first transverse link first end 381 and the third transverse link second end 386 is pivotally attached to the first longitudinal link second side 322 at the fourth pivot axis 364 and to the second longitudinal link second side 324 at the fifth pivot axis 365. The fourth transverse link first end 387 is pivotally attached to the handle at the sixth pivot axis 366 opposite the second transverse link first end 383 and the fourth transverse link second end 388 is pivotally attached to the first longitudinal link second side 322 at the seventh pivot axis 367 and to the second longitudinal link second side 324 at the eighth pivot axis 368.

When comparing the linkage mechanism 30 shown in FIG. 3B with the linkage mechanism 330 shown in FIG. 9, it is apparent that not all of the pivot axes are necessary in order to fully constrain the system. In fact half of the pivot axis connecting the longitudinal links 40, 42 to the triangular transverse links 50, 52 can be removed. In mechanism shown in FIG. 9, both longitudinal links 340, 342 are pinned on both the first sides 321, 323 and the second sides 322, 324 to the first and second transverse links 350, 352 on the first side 321, 323 and the third and fourth transverse links 353, 354 on the second sides 322, 324. However, in order to fully constrain each longitudinal link 340, 342, the longitudinal links 340, 342 need to be pivotally connected to at least two of the triangular transverse links. The two transverse links can be on the same sides of the transverse links as the linkage mechanism shown in FIG. 3B or on opposing sides of the longitudinal links in diagonal locations. For the latter configuration (based on the linkage mechanism shown in FIG. 9) the two diagonal links on opposing sides of the longitudinal links can comprise the first and fourth transverse links 350, 354 or the second and third transverse links 352, 353. It has been found that the two diagonal triangular transverse links can be replaced with four linear links on opposing sides of the longitudinal links resulting in the linkage mechanism shown in FIG. 10A and FIG. 10B.

Figure 10A:
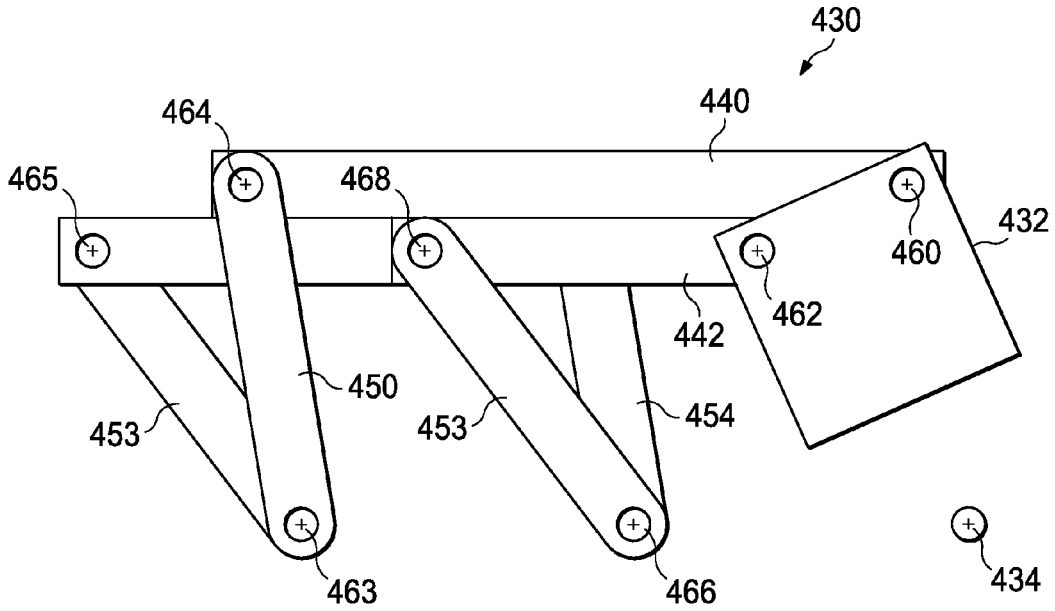
FIG. 10A is a side view of a simplified version of the linkage mechanism shown in FIG. 9 where the triangular transverse links have been replaced with linear transverse links.
Figure 10B:
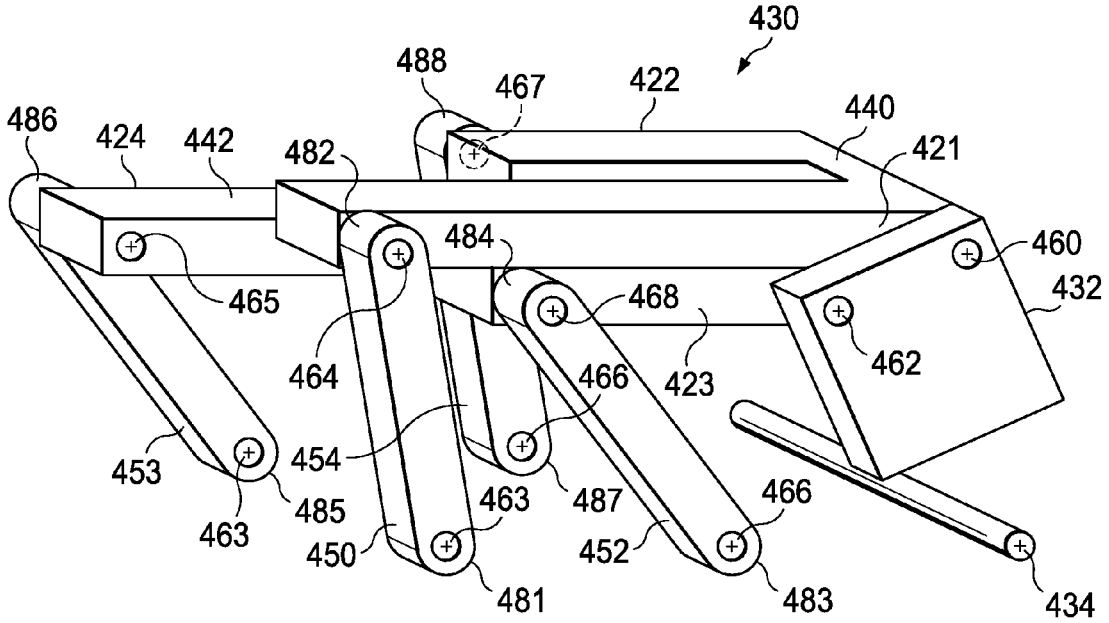
FIG. 10B is a perspective view of the linkage mechanism shown in FIG. 10A.

As shown in FIGS. 10A and 10B, a first transverse link second end 482 is pivotally attached to the first longitudinal link first side 421 at the fourth pivot axis 464 and the second transverse link second end 484 is pivotally attached to the second longitudinal link first side 423 at the eighth pivot axis 468. The linkage mechanism 430 further comprises a third transverse link 453 having a first end 485 and a second end 486 and a fourth transverse link 454 having a first end 487 and a second end 488. The third transverse link first end 485 is pivotally attached to the handle at the third pivot axis 463 opposite the first transverse link first end 481 and the third transverse link second end 486 is pivotally attached to the second longitudinal link second side 424 at the fifth pivot axis 465. The fourth transverse link first end 487 is pivotally attached to the handle at the sixth pivot axis 466 opposite the second transverse link first end 483 and the fourth transverse link second end 488 is pivotally attached to the first longitudinal link second side 422 at the seventh pivot axis 467. The first transverse link 450 and the fourth transverse link 454 are parallel and pivotally attached to opposite sides of the first longitudinal link 440 and the second transverse link 452 and the third transverse link 453 are parallel and pivotally attached to opposite sides of the second longitudinal link 442.

Since the four triangular transverse links in FIG. 9 are equilateral triangles, the triangular links are replaced with four linear transverse links that are equal in length corresponding to the lengths of the sides of the equilateral triangles. If the four triangular transverse links in FIG. 9 were right triangles, then the triangles could be replaced with linear links but linear links would not be equal in length resulting in more discrete parts.

Also, for the linkage mechanism design shown in FIG. 9, the cartridge carrier 332 could be removed and the linkage mechanism 330 would remain stable and continue to pivot as intended. However, if the cartridge is removed from the linkage mechanism 430 shown in FIG. 10A and FIG. 10B the mechanism becomes unstable. Therefore, the linkage mechanism 430 must include a cartridge carrier 432 for stability and to pivot as intended. This can be important when cartridge docking is considered.

As shown in FIG. 10A and FIG. 10B, the two linear transverse links on opposing sides of the linkage mechanism are leaning at different angles i.e. at a point during rotation one linear transverse link is leaning forward and the other linear transverse link is leaning back. As a result, a large spacing is required between adjacent transverse links on opposing sides of the linkage mechanism 430 in order to avoid clashing. An alternate embodiment of the linkage mechanism shown in FIGS. 10A and 10B is produced by swapping the second and fourth transverse links 452, 454 so that the first and second transverse links 450, 452 are disposed on the first side 421 of the first longitudinal link 440 and the third and fourth transverse links 453, 454 are disposed on the second side 424 of the second longitudinal link 442. The result is the linkage mechanism 430 shown in FIG. 11A and FIG. 11B where the second transverse link second end 484 is pivotally attached to the first longitudinal link first side 421 at the seventh pivot axis 467, and the fourth transverse link second end 488 is pivotally attached to the second longitudinal link second side 424 at the eighth pivot axis 468. In this embodiment, first transverse link 450 and the second transverse link 452 are parallel and pivotally attached to the first side 421 of the first longitudinal link 440 and the third transverse link 453 and the fourth transverse link 454 are parallel and pivotally attached to the second side 424 of the second longitudinal link 442. One benefit of the linkage mechanism 430 in FIG. 11A and FIG. 11B over the embodiment shown in FIG. 10A and FIG. 10B is that the length of the longitudinal links can now be reduced without resulting in clashing of either set of linear transverse links.

Figure 11A:
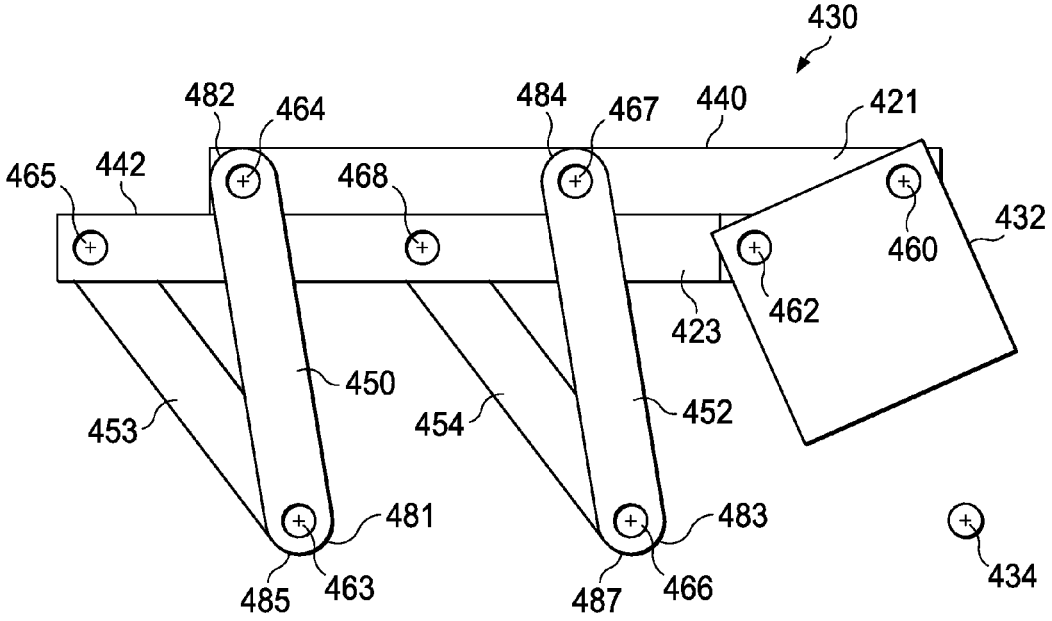
FIG. 11A is a side view of an alternate embodiment of the linkage mechanism shown in FIG. 10A.
Figure 11B:
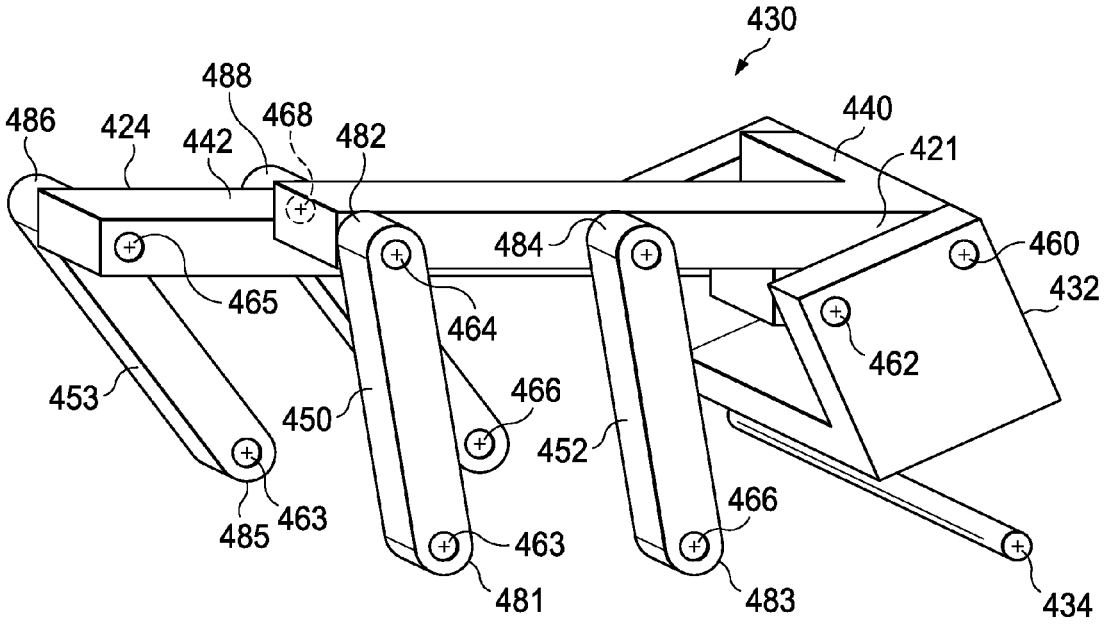
FIG. 11B is a perspective view of the linkage mechanism shown in FIG. 11A.
Figure 12A:
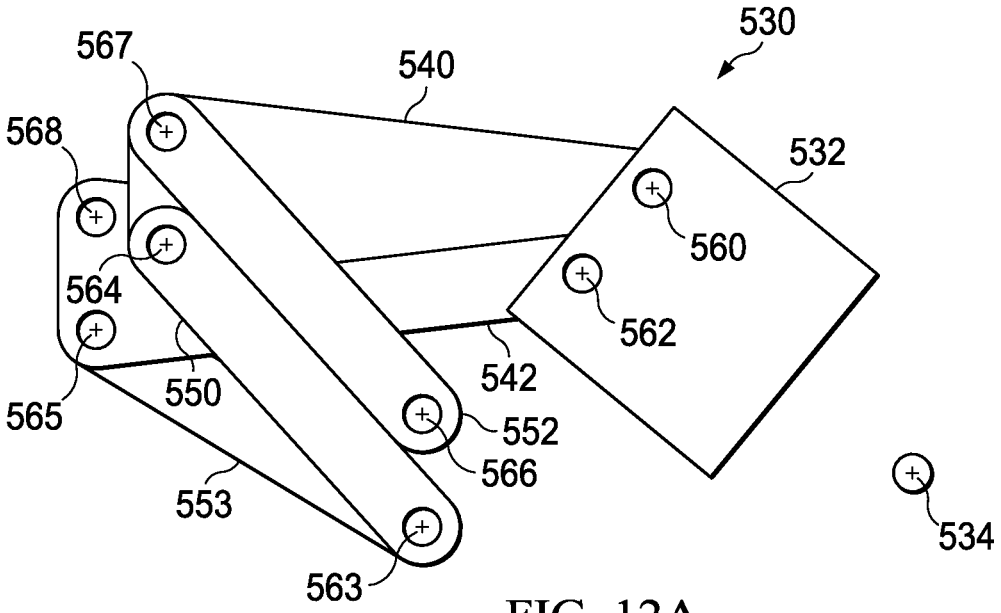
FIG. 12A is a side view of an alternate embodiment of the linkage mechanism shown in FIGS. 10A and 10B.
Figure 12B:
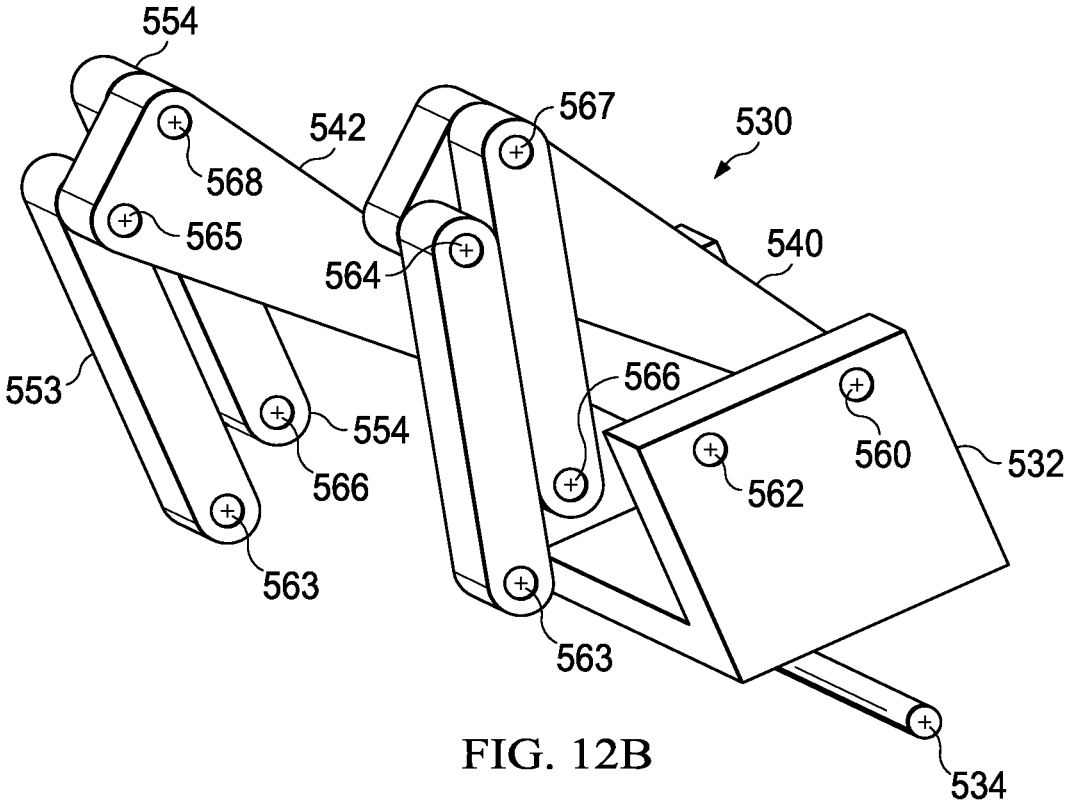
FIG. 12B is a perspective view of the linkage mechanism shown in FIG. 12A.

A further development of the linkage mechanism shown in FIG. 11A and FIG. 11B is to introduce an angular kink in the longitudinal links similar to that described in linkage mechanism in FIG. 8. This allows for improved tessellation of the two pairs of linear transverse links and further reduction in the size of the linkage mechanism. While optimizing the arrangement of the angular kink in the longitudinal links it was seen that using isosceles triangle shaped longitudinal links as shown in FIG. 7C for the longitudinal links offered opportunities for further simplification. The resulting linkage mechanism is illustrated in FIGS. 12A and 12B. Unlike the linkage mechanism in FIG. 11 where the longitudinal links are collinear, the longitudinal links in the linkage mechanism in FIG. 12A and FIG. 12B have an angular offset such that for the first longitudinal link 540, the distance between the first pivot axis 560 and the seventh pivot axis 567 is equal to the distance between the first pivot axis 560 and the fourth pivot axis 564 and for the second longitudinal link 542, the distance between the second pivot axis 562 and the eighth pivot axis 568 is equal to the distance between the second pivot axis 562 and the fifth pivot axis 565.

A potential drawback of this system is that the due to symmetrical nature of the mechanism the longitudinal and transverse links overlap during movement adding to the complexity of the design, particularly if molded live hinges are used.

Figure 13A:
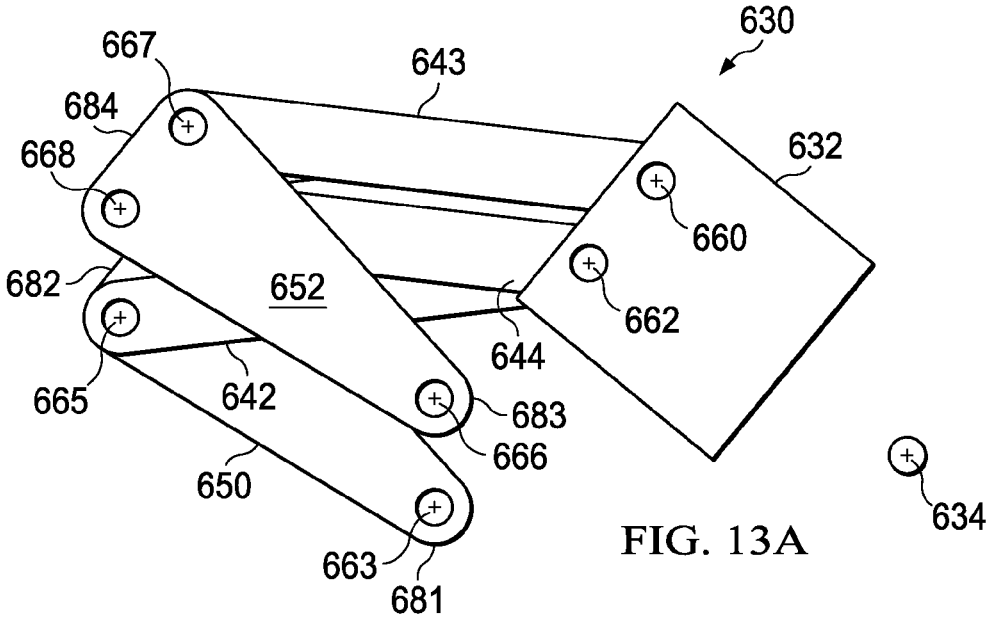
FIG. 13A is a side view of an alternate embodiment of the linkage mechanism shown in FIG. 12A.
Figure 13B:
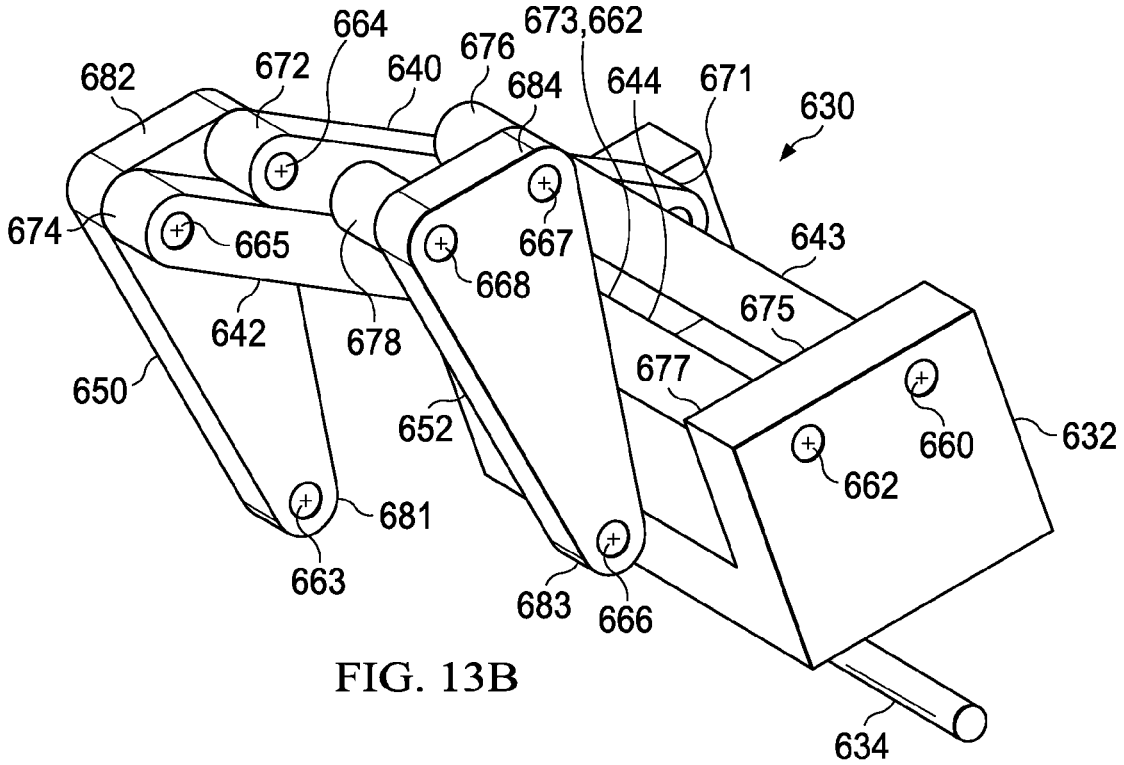
FIG. 13B is a perspective view of the linkage mechanism shown in FIG. 13A.

In an alternate embodiment shown in FIGS. 13A and 13B, the linkage mechanism 630 is opposite the linkage mechanism 530 shown in FIGS. 12A and 12B in that it comprises four linear longitudinal links each pivotally connected to the cartridge carrier 632 at one end and pivotally interconnected with one of two equilateral triangle transverse links 650, 652 at another end allowing the cartridge carrier 632 to pivot about a virtual pivot axis 634. The first and second transverse links 650, 652 are pivotally connected to and suspended from a handle at the third and sixth pivot axes 663, 666, respectively as described more fully below. Although the transverse links and the longitudinal links have been reversed such that the ladder embodiment in FIG. 13A and FIG. 13B includes two triangular transverse links and four linear longitudinal links, the linkage mechanism works on the same principle as the linkage mechanism in FIG. 12A and FIG. 12B. The ladder arrangement comprising four longitudinal links does not offer any benefits over the linkage mechanism in FIG. 12A and FIG. 12B comprising four transverse links in terms of size or complexity; however, it potentially offers more symmetry with the cartridge carrier 632 such that docking occurs at four points rather than two. This may be more visually appealing from a consumer point of view.

For the embodiment shown in FIGS. 13A and 13B, the first longitudinal link 640 has a first end 671 and a second end 672 opposite the first end 671. The first longitudinal link first end 671 is pivotally attached to the cartridge carrier 632 at a first pivot axis 660. A second longitudinal link 642 has a first end 673 and a second end 674 opposite the first end 673. The second longitudinal link first end 673 is pivotally attached to the cartridge carrier 632 at a second pivot axis 662. A third longitudinal link 643 has a first end 675 and a second end 676 opposite the first end 675. The third longitudinal link first end 675 is pivotally attached to the cartridge carrier 632 at the first pivot axis 660 opposite the first longitudinal link first end 671. A fourth longitudinal link 644 has a first end 677 and a second end 678 opposite the first end 671. The fourth longitudinal link first end 677 is pivotally attached to the cartridge carrier 632 at the second pivot axis 662 opposite the second longitudinal link first end 673. The two transverse links comprise a first transverse link 650 having a first end 681 and a second end 682 opposite the first end 681 and a second transverse link 652 having a first end 683 and a second end 684 opposite the first end 683. The first transverse link first end 681 is pivotally attached to the handle at a third pivot axis 663 and the first transverse link second end 682 is pivotally attached to the first longitudinal link second end 672 at a fourth pivot axis 664 and to the second longitudinal link second end 674 at a fifth pivot axis 665. Similar to the linkage mechanism embodiment shown in FIG. 4, the distance between the fourth pivot axis 664 and the third pivot axis 663 is a third distance 93, the distance between the fifth pivot axis 665 and the third pivot axis 663 is a fourth distance 94 and the distance between the fourth pivot axis 664 and the fifth pivot axis 665 is a second distance 92 equal to the first distance 91. The second transverse link first end 683 is pivotally attached to the handle at a sixth pivot axis 666 and the second transverse link second end 684 is pivotally attached to the third longitudinal link second end 676 at a seventh pivot axis 667 and to the fourth longitudinal link second end 678 at an eighth pivot axis 668. The distance between the seventh pivot axis and the sixth pivot axis is a sixth distance 96 equal to the third distance 93, the distance between the eighth pivot axis and the sixth pivot axis is a seventh distance 97 equal to the fourth distance 94 and the distance between the seventh pivot axis 67 and the eighth pivot axis 68 is a fifth distance 95 equal to the first distance 91. The virtual pivot axis 634 is separated from the first pivot axis 660 on the cartridge carrier 632 by an eighth distance 98 equal to the third distance 93 and is separated from the second pivot axis 662 on the cartridge carrier 632 by ninth distance 99 equal to the fourth distance 94.

A potential downside with the separating the longitudinal links and the transverse links into four separate linear linkages as described in the embodiments above is instability due to the increase in the number of moving parts. Therefore, it was found that a more stable linkage mechanism system could be provided by combining the triangular longitudinal links from the embodiment in FIG. 12A and FIG. 12B with the triangular transverse links from the embodiment in FIG.

13A and FIG. 13B. The result is the dual isosceles linkage mechanism 730 shown in FIG. 14A and FIG. 14B. The advantages of the dual isosceles linkage mechanism over the mechanism shown in FIGS. 12A and 12B and FIGS. 13A and 13B include a reduced part count as well as a restored link between the first and second longitudinal links 740, 742 which improves stability.

Figure 14A:
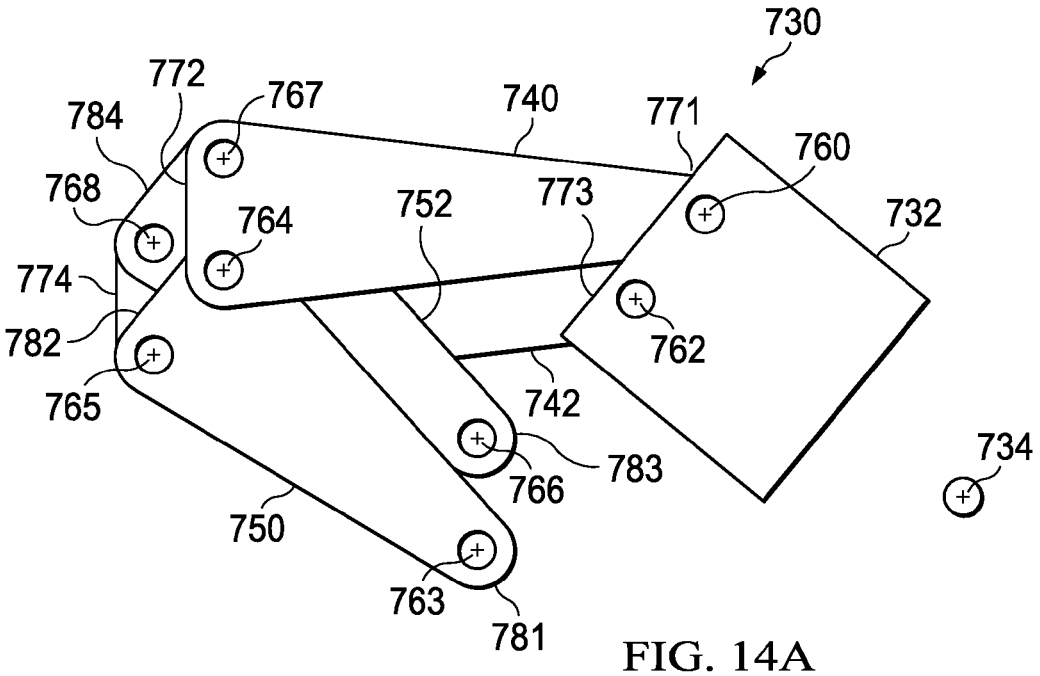
FIG. 14A is a side view of an alternate embodiment of a linkage mechanism for a razor which is a combination of the linkage mechanisms shown in shown in FIG. 12A and FIG. 13A.
Figure 14B:
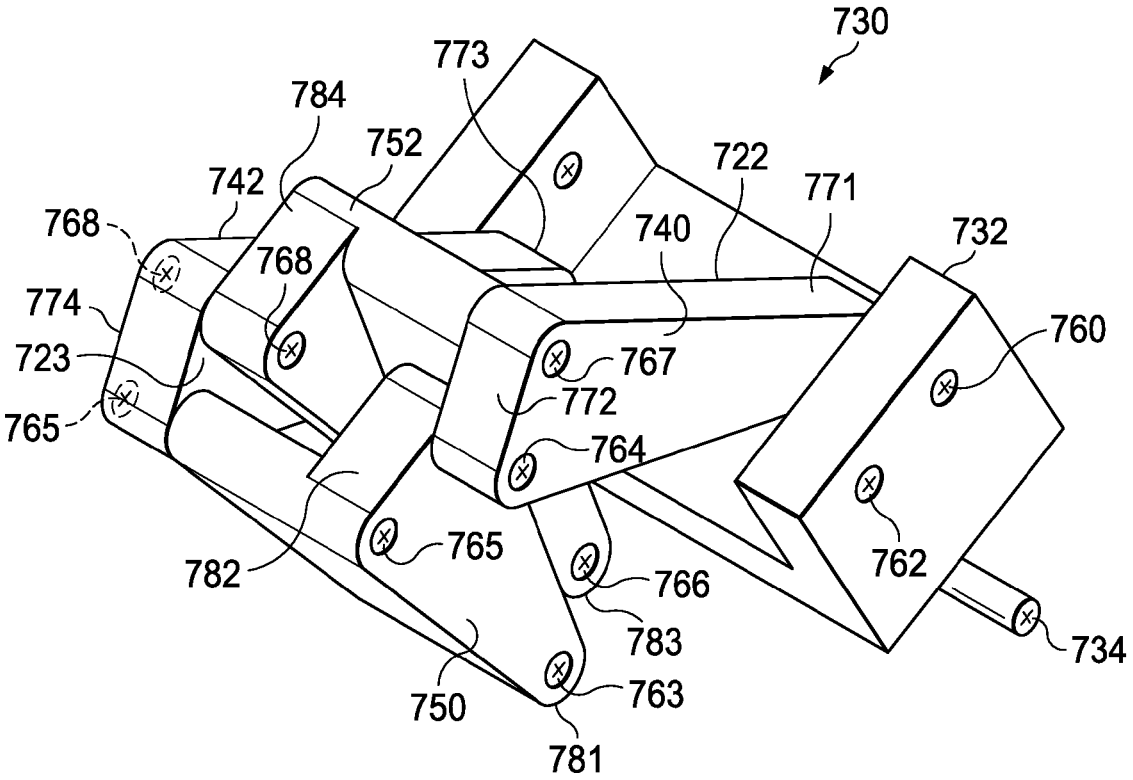
FIG. 14B is a perspective view of the linkage mechanism shown in FIG. 14A.

As shown in FIGS. 14A and 14B, the first and second longitudinal links 740, 742 are isosceles triangles such that the fourth pivot axis 764 and the seventh pivot axis 767 at the second end 772 of the first longitudinal link 740 are disposed equidistant from the first pivot axis 760 at the first end 771 of the first longitudinal link 740 and the fifth pivot axis 765 and the eighth pivot axis 768 at the second end 774 of the second longitudinal link 742 are disposed equidistant from the second pivot axis 762 at the first end 773 of the second longitudinal link 742. The transverse links 750, 752 also form isosceles triangles such that the fourth pivot axis 764 and fifth pivot axis 765 at the second end 782 of the first transverse link 750 are disposed equidistant from the third pivot axis 763 at the first end 781 of the first transverse link 750 and the seventh pivot axis 767 and the eighth pivot axis 768 at the second end 784 of the second transverse link 752 are disposed equidistant from the sixth pivot axis 766 disposed at the first end 783 of the second transverse link 752. As shown, the first transverse link second end 782 is pivotally attached to the second side 722 of first longitudinal link 740 at the fourth pivot axis 764 and pivotally attached to the first side 723 of the second longitudinal link 742 at the fifth pivot axis 765. The second end 784 of the second transverse link 752 is pivotally attached to the second side 722 of first longitudinal link 740 at the seventh pivot axis 767 and pivotally attached to the first side 723 of the second longitudinal link 742 at the eight pivot axis 768.

Figure 15:
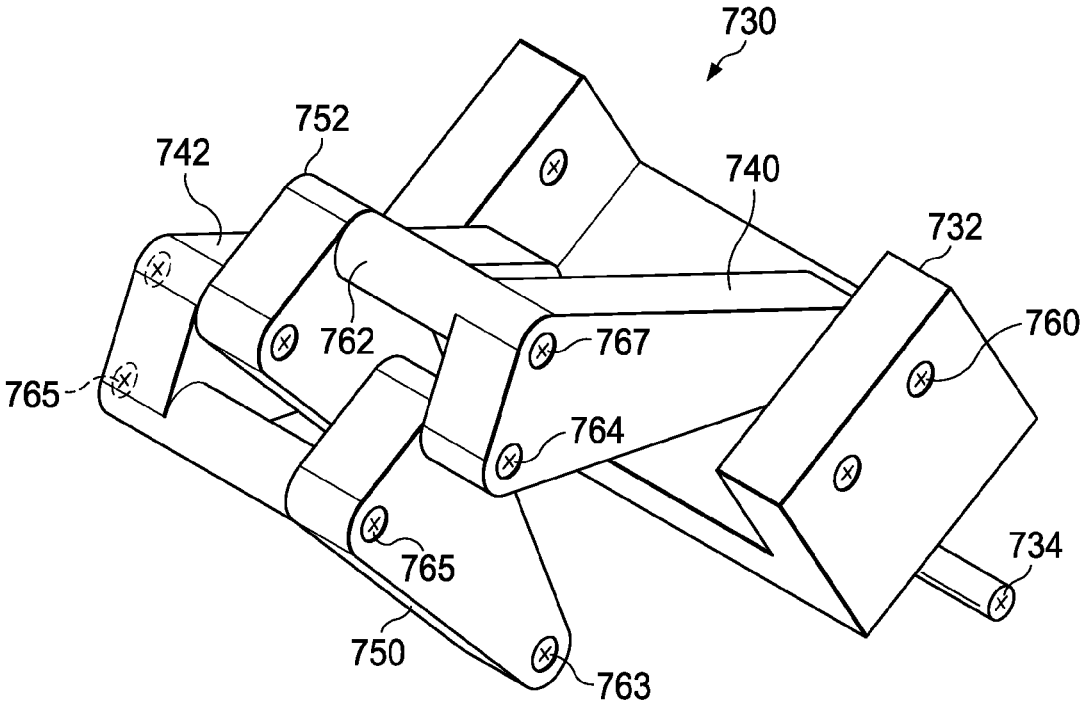
FIG. 15 is a perspective view of an alternate embodiment of the linkage mechanism shown in FIGS. 14A and 14B.

As shown in FIG. 14B, the first and second longitudinal links 740, 742 comprise flat isosceles triangles that are pivotally connected to the first and second transverse links 750, 752 via connecting features molded into to the triangular first and second transverse links 750, 752. The linkage mechanism 730 shown in FIG. 15 works in the same way as the linkage mechanism 730 in FIG. 14B; however, the connection features have been reversed such that the first and second longitudinal links 740, 742 comprise isosceles triangles including connection features molded into the longitudinal links and the first and second transverse links 750, 752 comprise flat isosceles triangles. The advantage of the linkage mechanism shown in FIG. 15 is that it is more likely that the first and second longitudinal links 740, 742 would be styled in a final product adding complexity to the part. Therefore, it may be more beneficial to concentrate the complexity of the connection features and styling in the longitudinal links and designing the first and second transverse links with more simple profiles.

For some applications it may be necessary to change the linkage mechanism to accommodate space available and to simplify the mechanism by reducing the number interconnected parts by eliminating one of the pivot axes while at the same time simplifying a couple of the links. Examples of such simplified linkage mechanisms are shown in FIG. 16 to FIG. 20. The linkage mechanism can also be simplified by introducing live hinges. A linkage mechanism embodiment including live hinges is illustrated in FIG. 21 which is fully described below.

The four bar linkage mechanism comprising eight pivot axes shown in FIG. 4 can be modified by removing one of the pivot axes interconnecting the longitudinal and transverse links without affecting the function of the mechanism. The pivot axes that can be removed are the fourth pivot axis 64, the fifth pivot axis 65, the seventh pivot axis 67 and the eighth pivot axis 68. Linkage mechanism designs having one of these four pivot axis removed must include a cartridge carrier 32 or cartridge 20 pivotally connected to the system in order for the mechanism to be stable and function correctly. Modifying the linkage mechanism in this way reduces the complexity by eliminating one pivot axis and simplifying one of the transverse links and one of the longitudinal links. The resulting linkage mechanisms are shown in FIGS. 16 to 20.

Similar to the embodiment shown in FIG. 4, for each of the embodiments shown in FIGS. 16 to 20, the linkage mechanism comprises two longitudinal links 840, 842 each pivotally connected to the cartridge carrier 832 at one end and pivotally interconnected with two transverse links 850, 852 at an opposite end. The two transverse links 850, 852 are pivotally connected to and suspended from the handle 814. The first longitudinal link first end 871 is pivotally attached to the cartridge carrier 832 at a first pivot axis 860. The second longitudinal link first end 873 is pivotally attached to the cartridge carrier 832 at a second pivot axis 862. The first transverse link first end 881 is pivotally attached to the handle 814 at a third pivot axis 863 and the second transverse link first end 883 is pivotally attached to the handle 814 at a sixth pivot axis 866. The first transverse link second end 882 is pivotally attached to at least one of the first longitudinal link second end 872 at a fourth pivot axis 864 and the second longitudinal link second end 874 at a fifth pivot axis 865. The second transverse link second end 884 is pivotally attached to at least one of the first longitudinal link 840 at a seventh pivot axis 867 and the second longitudinal link 842 at an eighth pivot axis 868. As shown in the embodiments in FIG. 16 through FIG. 20, at least one of the first transverse link 850 or the second transverse link 852 is pivotally attached to both the first longitudinal link 840 and the second longitudinal link 842.

Figure 16:
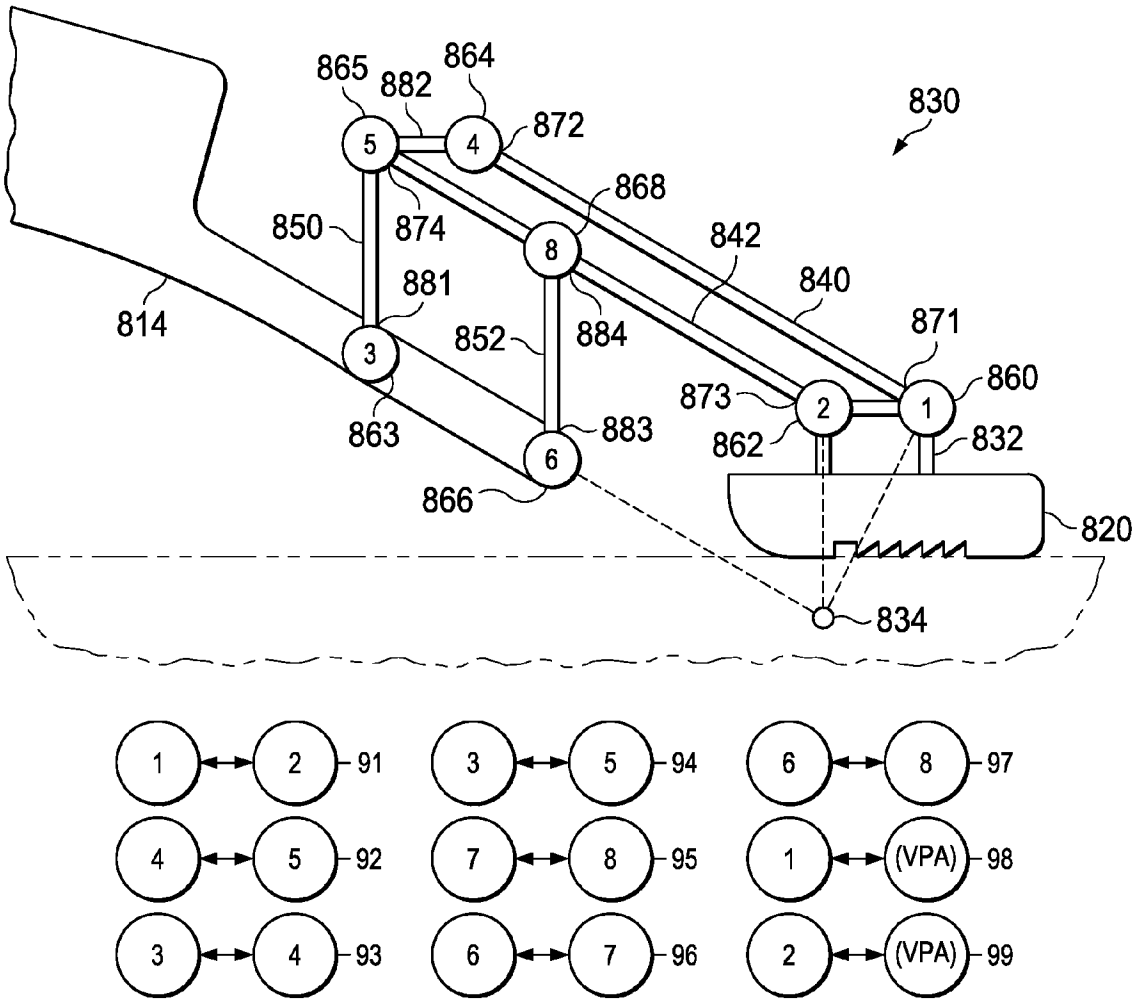
FIG. 16 is an alternate embodiment of the linkage mechanism shown in FIG. 4.
Figure 17:
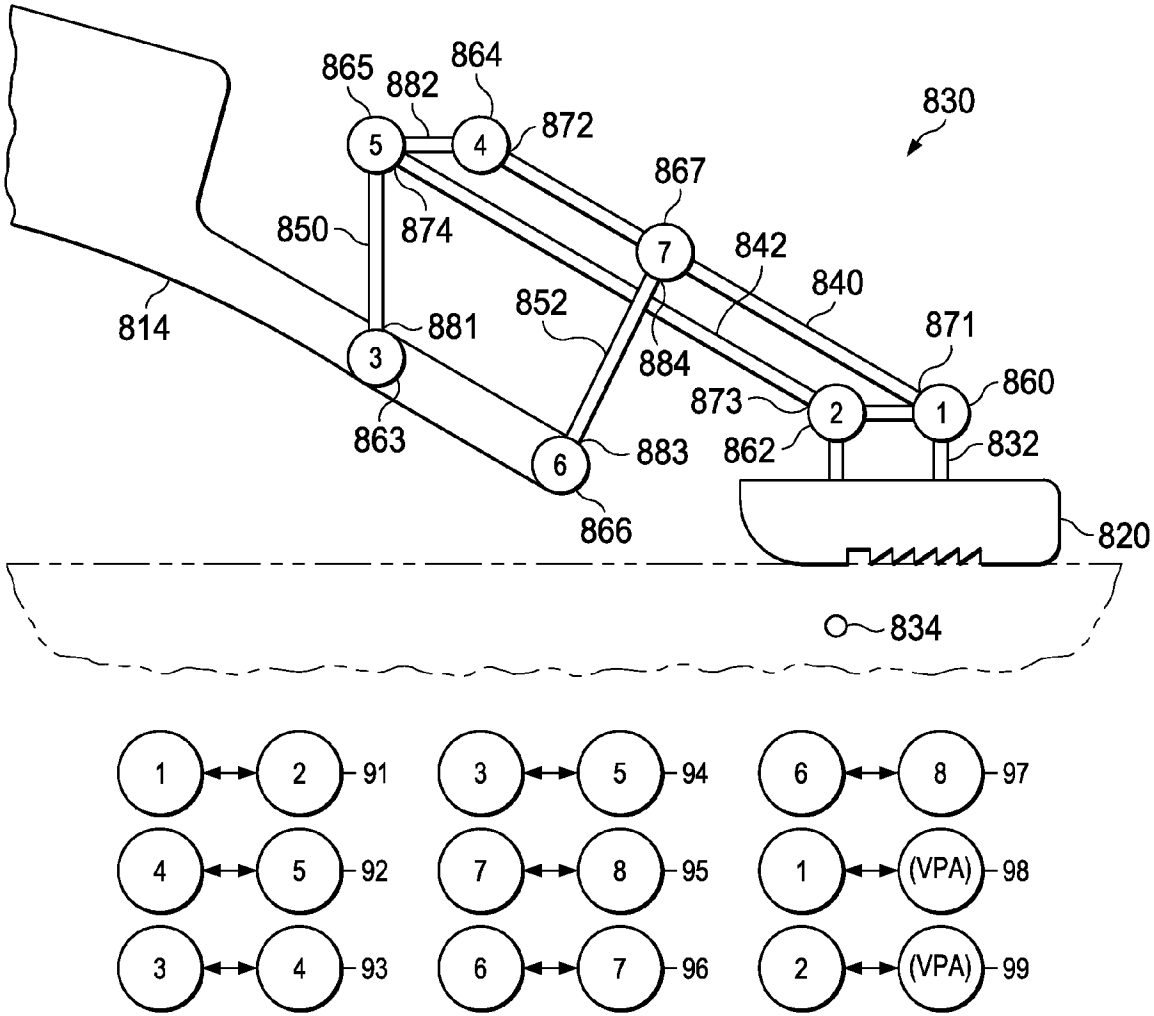
FIG. 17 is an alternate embodiment of the linkage mechanism shown in FIG. 16.

In the embodiment shown in FIGS. 16 and 17, the first transverse link second end 882 is pivotally attached to the first longitudinal link second end 872 at the fourth pivot axis 864 and to the second longitudinal link second end 874 at the fifth pivot axis 865. The fourth pivot axis 864 is separated from the fifth pivot axis 865 by a second distance 92 equal to the first distance 91. For this embodiment the second transverse link second end 884 can be pivotally connected to either the second longitudinal link 842 at the eighth pivot axis 868 as shown in FIG. 16 or the first longitudinal link 840 at the seventh pivot axis 867 as shown in FIG. 17.

For the embodiment shown in FIG. 16, the second transverse link 852 has been simplified from a right angle second transverse link 52 having three pivot axes as shown in FIG. 4 to a linear transverse link having two pivot axes (sixth pivot axis 866 and eighth pivot axis 868) by eliminating the seventh pivot axis. Also the first longitudinal link 40 in FIG. 4 is further simplified by removing the seventh pivot axis 67. Similarly, for the embodiment shown in FIG. 17, the right angle second transverse link 52 in FIG. 4 has been simplified to a linear second transverse link 852 having two pivot axes (sixth pivot axis 866 and seventh pivot axis 867) by eliminating the eighth pivot axis 68 from the linkage mechanism 30 shown in FIG. 4. The second longitudinal link 42 in FIG. 4 has also been simplified by removing the eighth pivot axis 68.

Figure 18A:
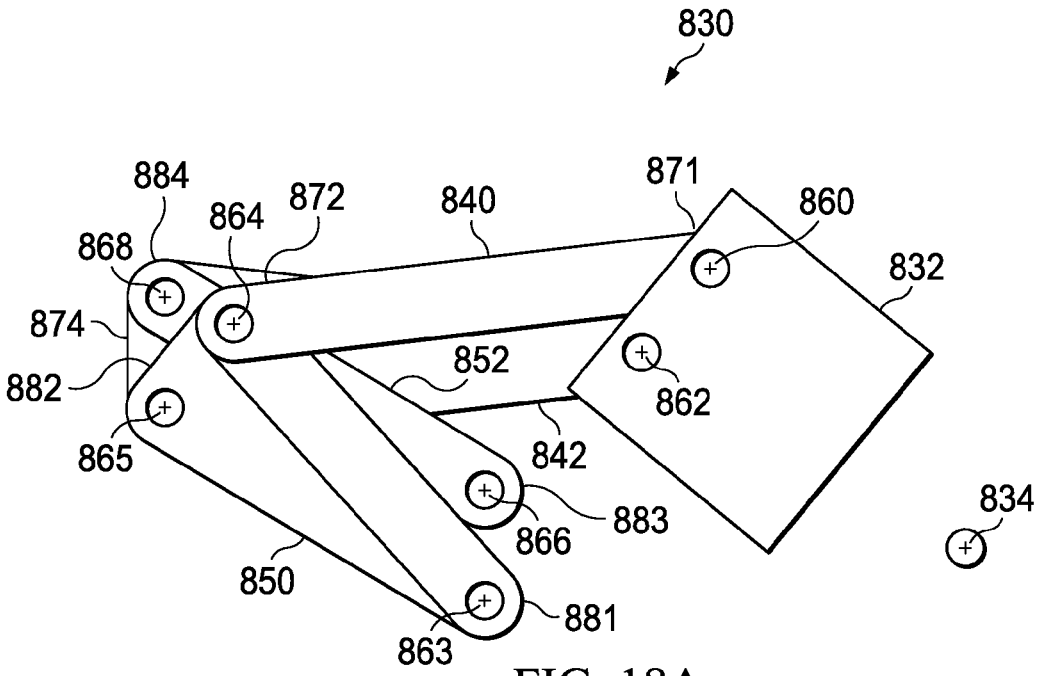
FIG. 18A is an alternate embodiment of the linkage mechanism shown in FIG. 16.
Figure 18B:
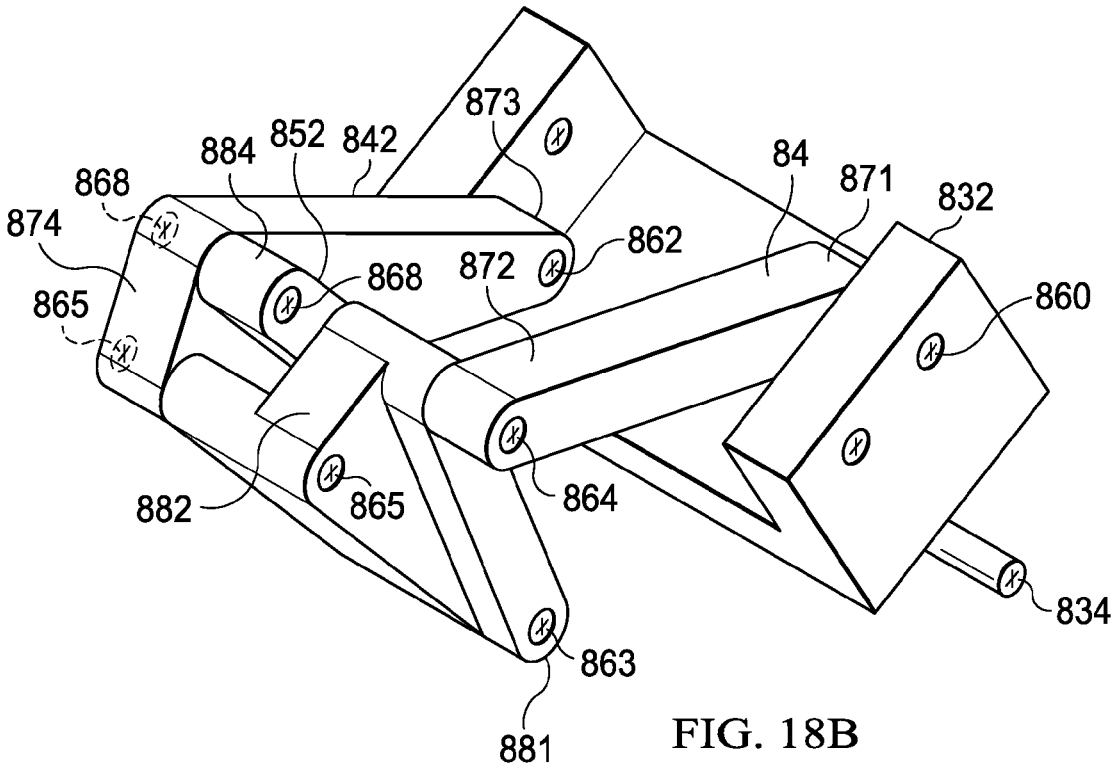
FIG. 18B is a perspective view of the linkage mechanism shown in FIG. 18A.

This same principal can be used to optimize the linkage mechanism illustrated in FIGS. 14A and 14B. As shown in FIG. 18A and FIG. 18B, the seventh pivot axis 767 in FIG. 14B can be removed and the second triangular transverse link 752 can be modified into a linear second transverse link 852 as shown in FIG. 18B having the sixth pivot axis 866 attached to the handle at one end and the eighth pivot axis 868 attached to the second longitudinal link 842 at the other end. Also, by removing the seventh pivot axis 767, the first longitudinal link 740 can be changed from a triangular first longitudinal link 740 as shown in FIG. 14B to the linear first longitudinal link 840 shown in FIG. 18B.

Figure 19:
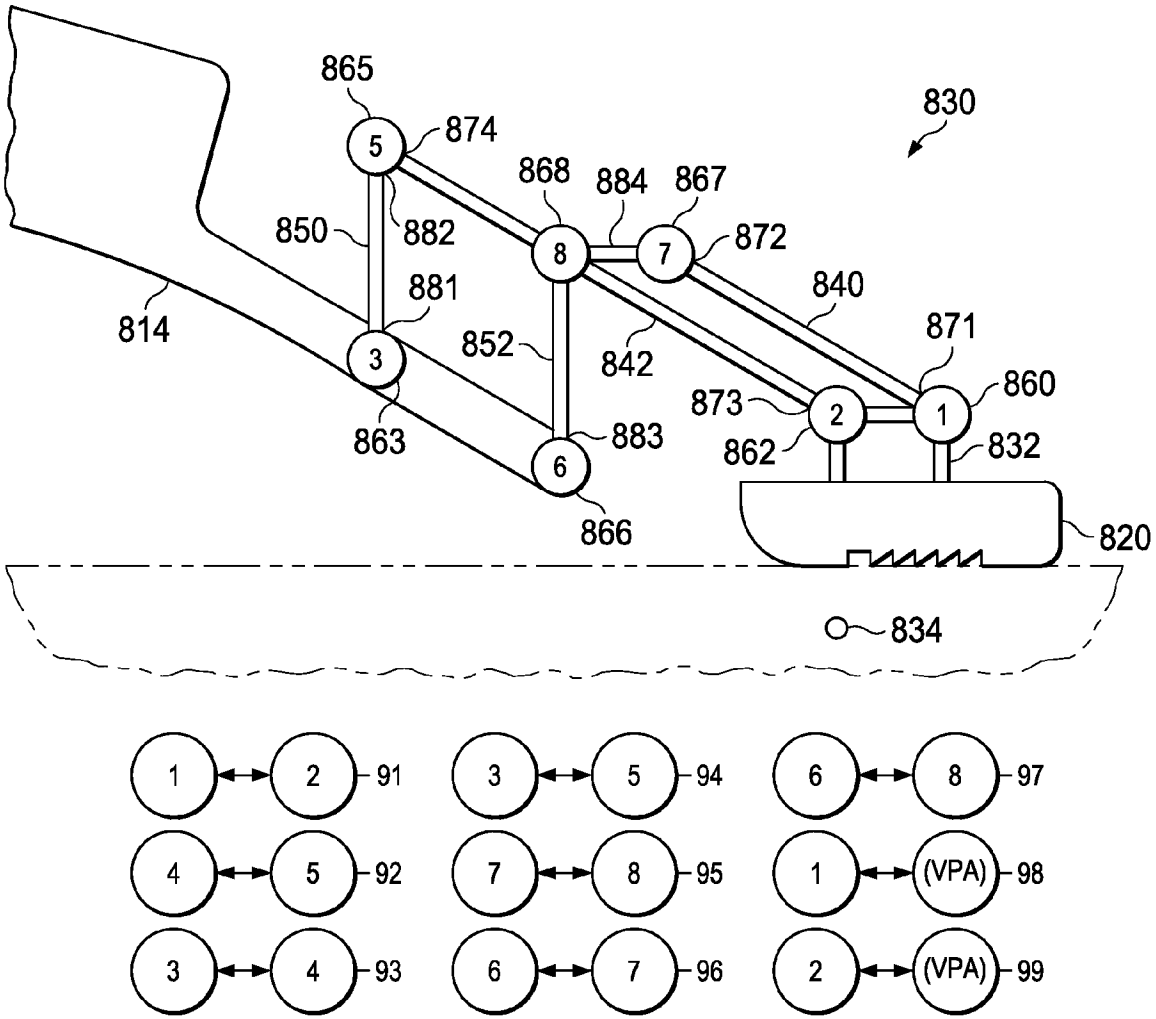
FIG. 19 is an alternate embodiment of the linkage mechanism shown in FIG. 4.
Figure 20:
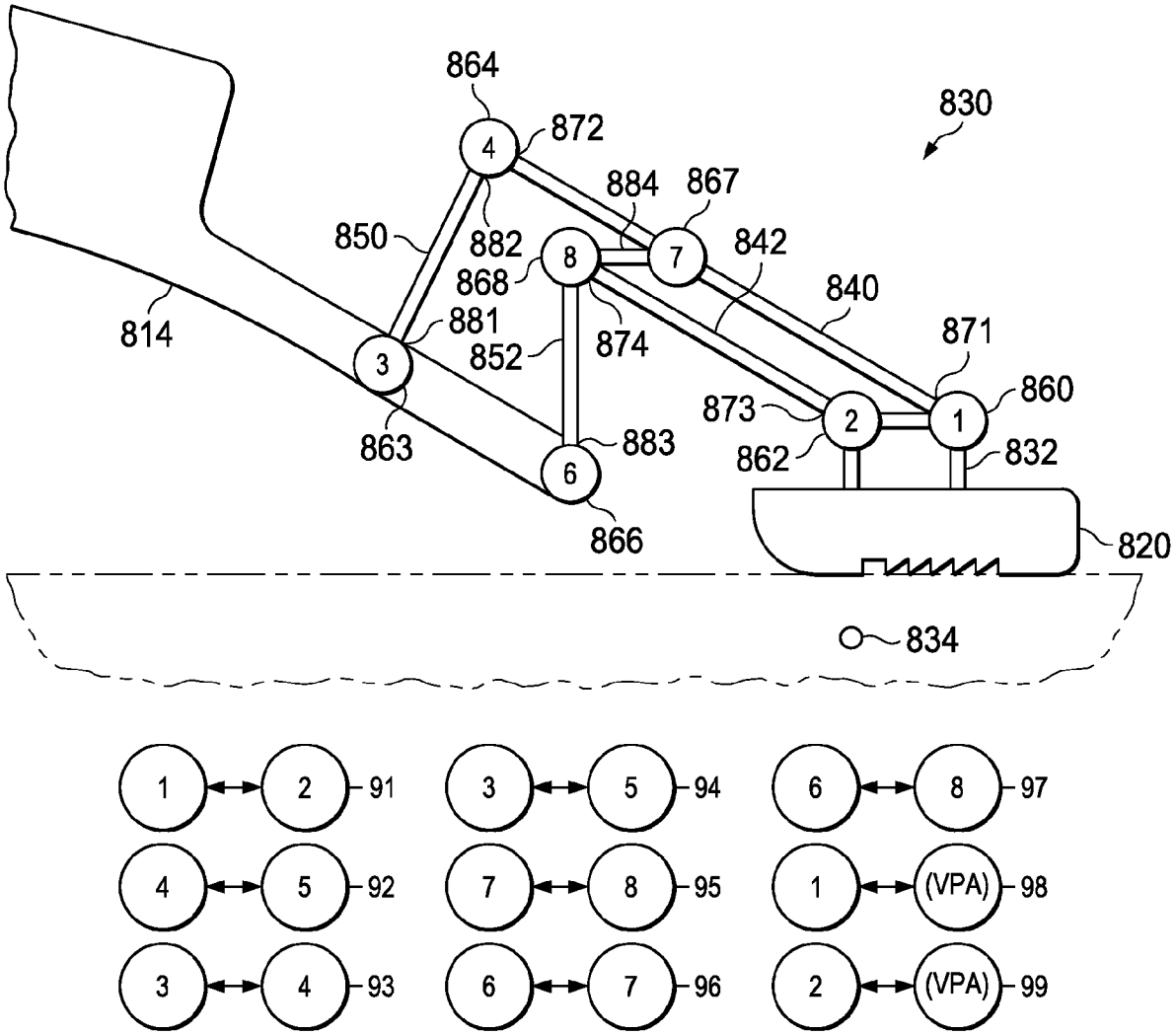
FIG. 20 is an alternate embodiment of the linkage mechanism shown in FIG. 19.
Figure 21:
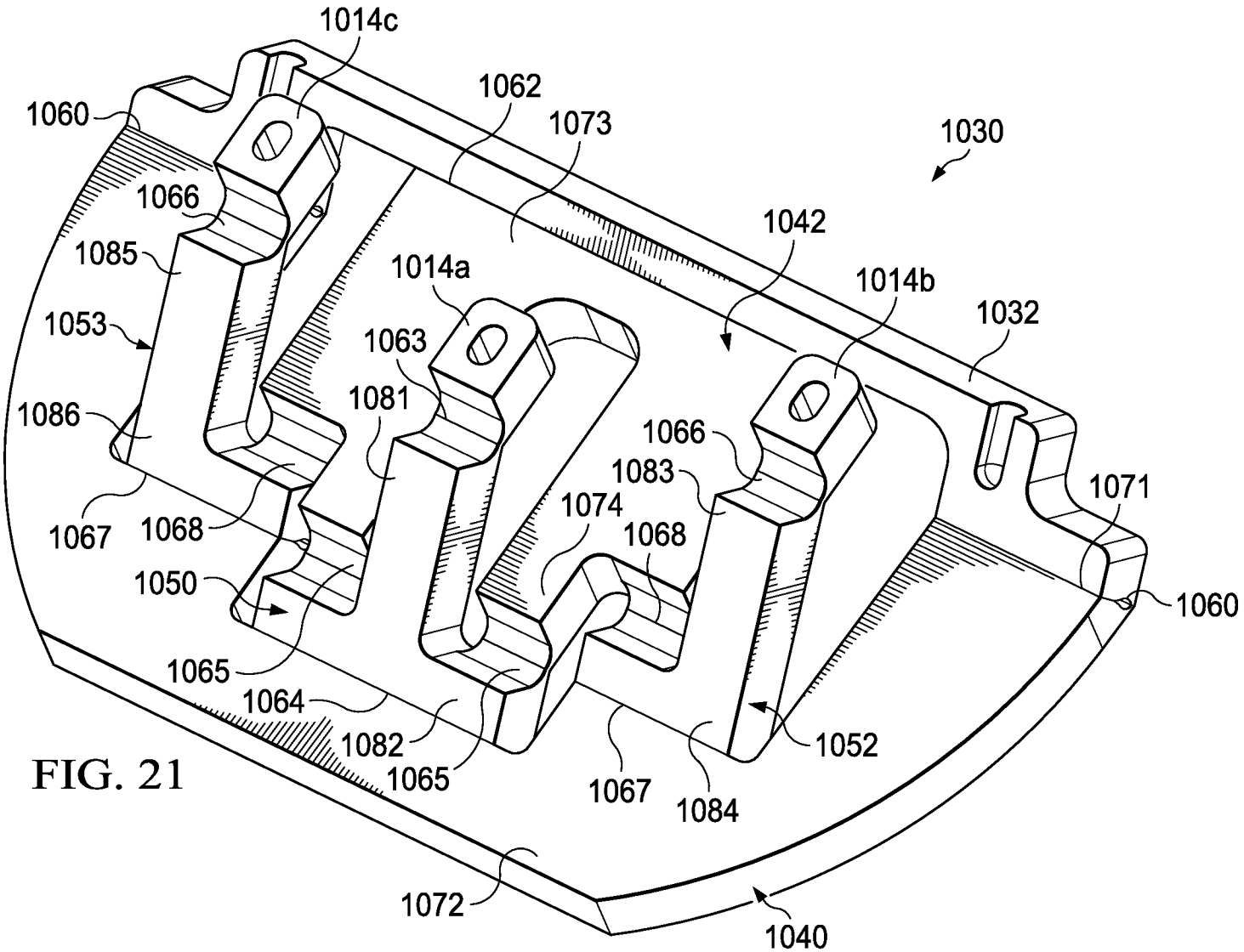
FIG. 21 is a perspective view of a linkage mechanism for a razor.

In another embodiment shown in FIGS. 19 and 20, the second transverse link 852 is pivotally attached to the first longitudinal link second end 872 at the seventh pivot axis 867 and pivotally attached to the second longitudinal link 842 at the eighth pivot axis 868. The seventh pivot axis 867 is separated from the eighth pivot axis 868 by a fifth distance 95 equal to the first distance 91. For this embodiment the first transverse link second end 882 can be pivotally attached to the second longitudinal link 842 at the fifth pivot axis 865 as shown in FIG. 19 or pivotally attached to the first longitudinal link 840 at the fourth pivot axis 864 as shown in FIG. 20.

For the embodiment shown in FIG. 19, the first transverse link 850 has been simplified from a right angle first transverse link 50 having three pivot axes as shown in FIG. 4 to a linear first transverse link 850 having two pivot axes (third pivot axis 863 and fifth pivot axis 865) by eliminating the fourth pivot axis 64. Also the first longitudinal link 40 in FIG. 4 is further simplified by removing the fourth pivot axis 64. Similarly, for the embodiment shown in FIG. 20, the right first transverse link 50 of FIG. 4 has been simplified to a linear first transverse link 850 having two pivot axes (third pivot axis 863 and fourth pivot axis 864) by eliminating the fifth pivot axis 65 of FIG. 4. The first longitudinal link 40 in FIG. 4 has also been simplified by removing the fifth pivot axis 65.

The linkage mechanism shown in FIG. 21 illustrates an embodiment where the linkage mechanism has been simplified by introducing live hinges to all of the pivot axes. The linkage mechanism 1030 illustrated in FIG. 21 includes a first longitudinal link 1040 and a second longitudinal link 1042 pivotally interconnected with a first transverse link 1050, a second transverse link 1052 and a third transverse link 1053 via live hinges. The linkage mechanism 1030 is pivotally connected to and suspended from the handle at one end via the handle connecting features, 1014*a*, 1014*b*, 1014*c* at the first ends of the transverse links and pivotally connected to the cartridge carrier 1032 at the other end via the longitudinal links.

For the linkage mechanisms shown in FIG. 21, the first longitudinal link 1040 has a first end 1071 and a second end 1072 opposite the first end 1071. The first longitudinal link first end 1071 is pivotally attached to the cartridge carrier 1032 at a first pivot axis 1060. The second longitudinal link 1042 has a first end 1073 and a second end 1074 opposite the first end 1073. The second longitudinal link first end 1073 is pivotally attached to the cartridge carrier 1032 at a second pivot axis 1062.

The first transverse link 1050 has a first end 1081 and a second end 1082 opposite the first end 1081. The first transverse link first end 1081 is pivotally attached to the handle connecting feature 1014*a* at a third pivot axis 1063 and the first transverse link second end 1082 is pivotally attached to the first longitudinal link second end 1072 at a fourth pivot axis 1064 and the second longitudinal link second end 1074 at a fifth pivot axis 1065.

The second transverse link 1052 has a first end 1083 and a second end 1084 opposite the first end 1083. The second transverse link first end 1083 is pivotally attached to the handle connecting feature 1014*b* at a sixth pivot axis 1066 and the second transverse link second end 1084 is pivotally attached to the first longitudinal link 1040 at a seventh pivot axis 1067 and the second longitudinal link 1042 at an eighth pivot axis 1068.

The third transverse link first end 1085 is pivotally attached to the handle connecting feature 1014*c* at the sixth pivot axis 1066 opposite the second transverse link first end 1083 and the third transverse link second end 1086 is pivotally attached to the first longitudinal link second end 1072 at the seventh pivot axis 1067 opposite the second transverse link second end 1084 and to the second longitudinal link second end 1074 at the eighth pivot axis 1068 opposite the second transverse link second end 1084. The corresponding linkage mechanism produces a virtual pivot axis beneath the cartridge carrier 1032 similar to the embodiments previously described.

Figure 22A:
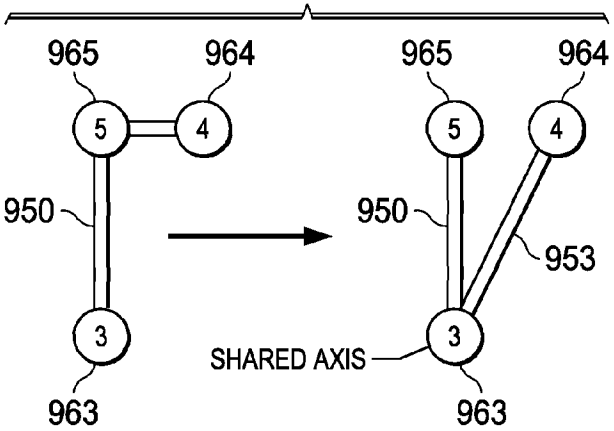
FIG. 22A is a side view of a transverse link and a split transverse link.

Another technique that can be used to modify the linkage mechanism in FIG. 4 is to split any of the four links into two minor links (also referred to as split links) so that a single link with three pivot points becomes two minor links with two pivot points. The two minor links share a common pivot axis which can be any of the three axes making up the original, presplit link. For this embodiment, no more than two of the four links comprising the first longitudinal link, the second longitudinal link, the first traverse link, and the second traverse link can be split into two minor links. An example of splitting a transverse link is shown in FIG. 22A where the first transverse link 950 has been split into two transverse links, a first transverse link 950 and a third transverse link 953 sharing common pivot axis 963.

It may seem that using this technique makes the mechanism more complex but the potential benefit comes when trying to layout a mechanism in three dimensions. Depending on the space available, it can sometimes be more convenient to have two parts rather than one. Also, depending on the manufacturing method it could potentially be advantageous to have two simple parts rather than one more complex one. As with most of the modifications described, the potential drawback of this technique is stability, since the more separate parts that the linkage mechanism includes the greater the potential for the mechanism to become unstable due to tolerances.

It is important to note that it is not possible to combine this technique with the previous modification described above (removing one of the pivot axes) and shown in FIGS. 16 through 20 as this introduces too many degrees of freedom into the linkage system.

There are four separate scenarios for splitting the links that follow slightly different rules; however, each scenario can produce multiple linkage mechanism embodiments.

Figure 22B:
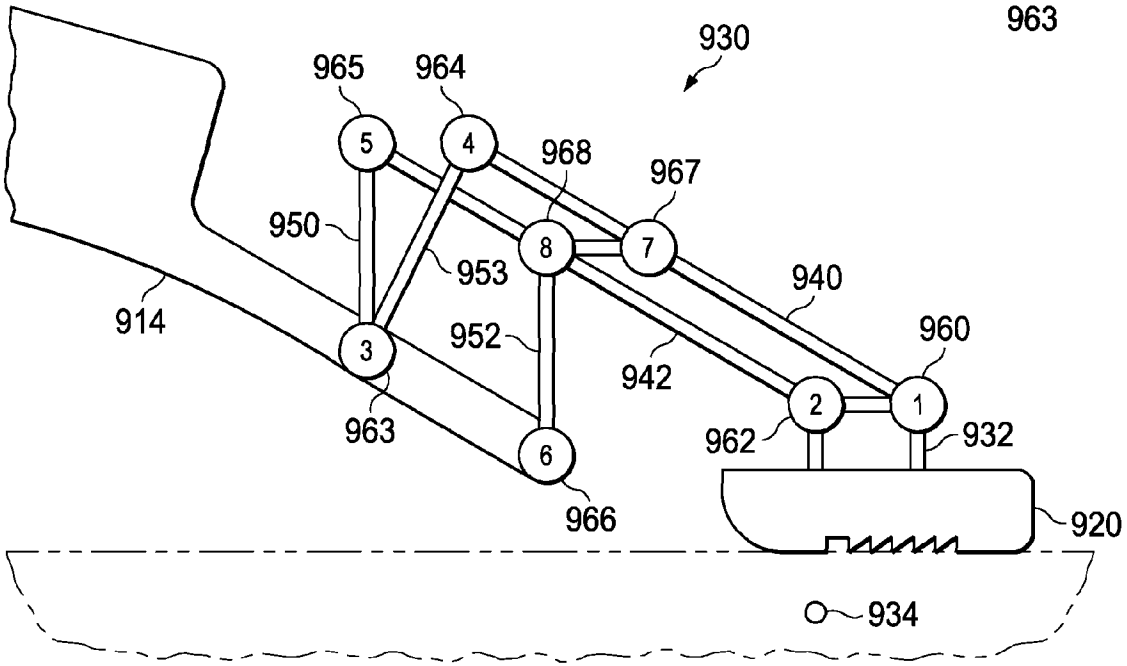
FIG. 22B is a side view of the linkage mechanism shown in FIG. 4 incorporating the split transverse link shown in FIG. 22A.

For the first scenario, it is possible to split any one of the four links in the system into two minor links as shown in FIG. 22A and for the shared axis to be any of the three axes of the presplit link. So the first transverse link 50 shown in FIG. 4, the link could be split in three different ways by having the two minor links share the third pivot axis 63, the fourth pivot axis 64 or the fifth pivot axis 65. Splitting only one link per this scenario (any of the four links in three different ways) can result in twelve different embodiments. For the first scenario embodiment shown in FIG. 22B, the first transverse link 50 has been split into two minor links, first minor transverse link 950 and third minor transverse link 953, which share the third pivot axis 963 as the common pivot axis, all of the other links remain unchanged. As a result, an additional third transverse link 953 has been formed.

A second scenario involves applying the same rules described in the first scenario to any two links as long as one of the links is a transverse link and the other link is a longitudinal link. Both of the minor links can have a shared axis at any of the three axes from their respective presplit links. This second scenario can produce thirty six different embodiments as each transverse-longitudinal pair can produce nine different link combinations and there are four possible different pairs. An example of the second scenario embodiment is illustrated in FIG. 23.

Figure 23:
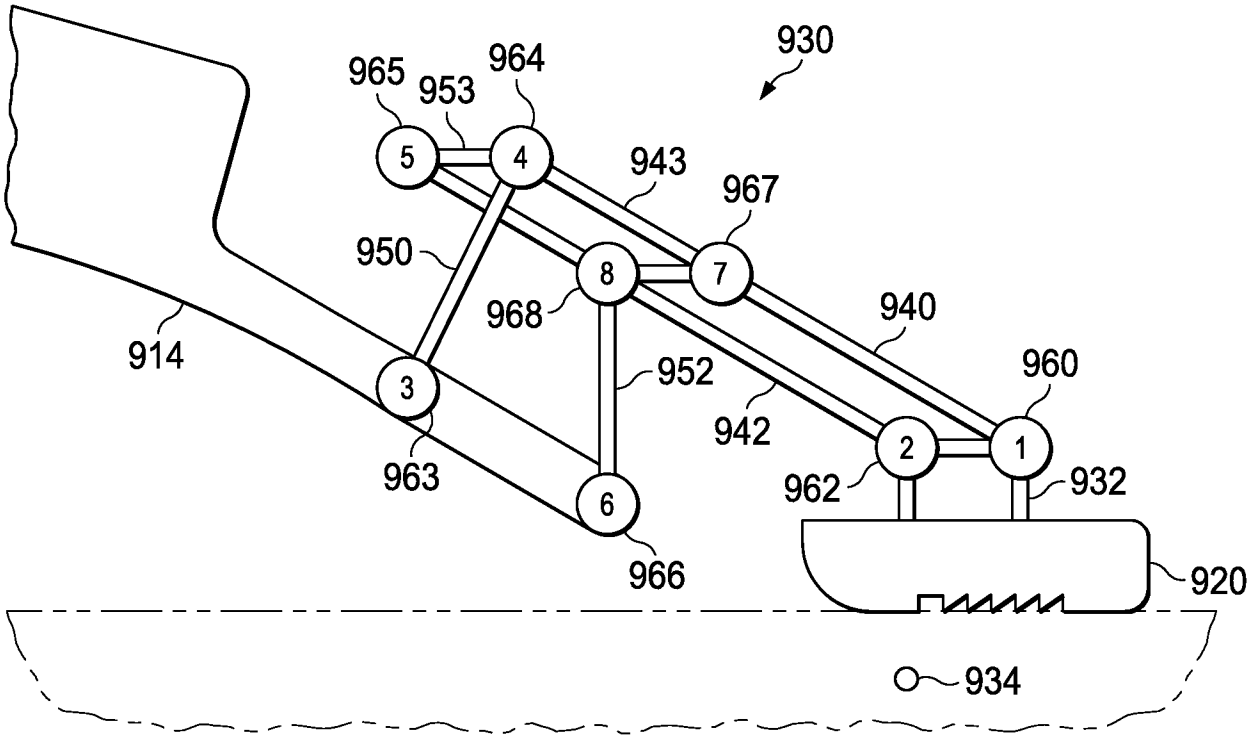
FIG. 23 is an alternate embodiment of the linkage mechanism shown in FIG. 4 incorporating a split transverse link and a split longitudinal link.

For the second scenario embodiment illustrated in FIG. 23, the first transverse link 50 from FIG. 4 has been split into two minor links which share the fourth pivot axis 964 and the first longitudinal link 40 has been split into two minor links which share the seventh pivot axis 967. As a result, a third transverse link 953 between the fourth pivot axis 964 and the fifth pivot axis 965 and a third longitudinal link 943 between the seventh pivot axis 967 and the fourth pivot axis 964 have been formed.

Figure 24:
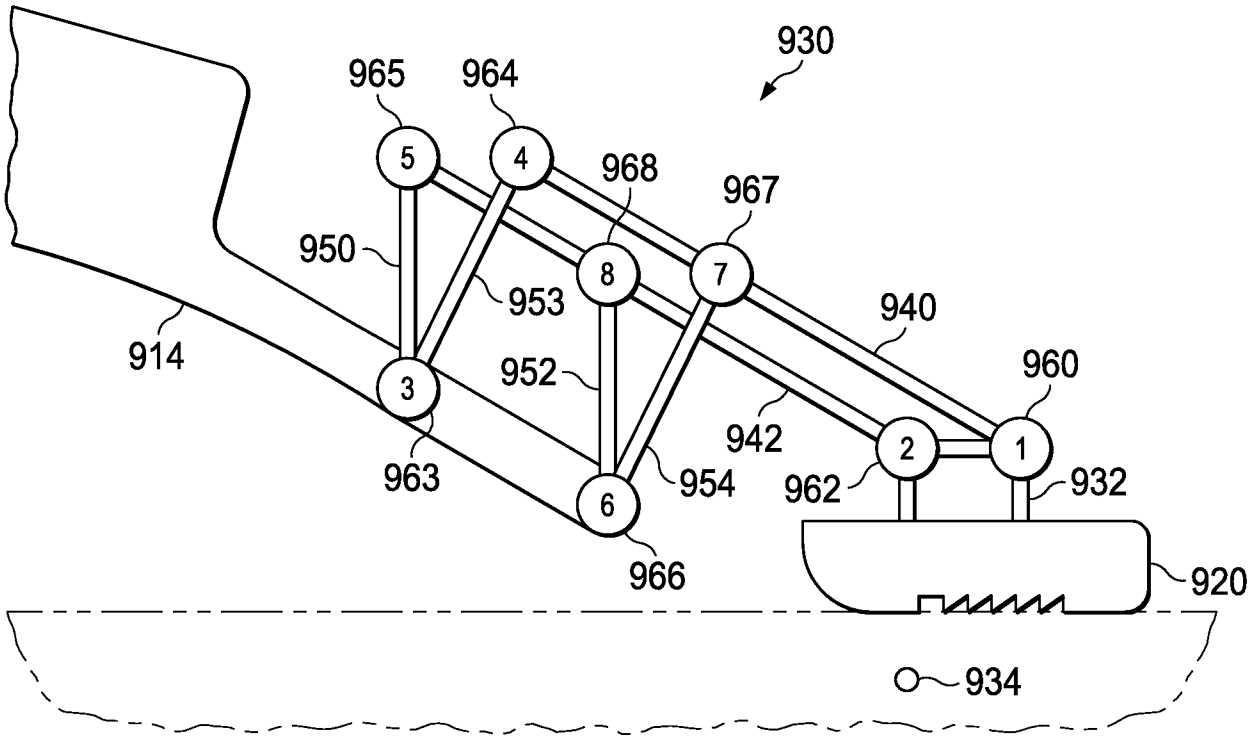
FIG. 24 is an alternate embodiment of the linkage mechanism shown in FIG. 4 incorporating two identical split transverse links.

For a third scenario, either the first and second transverse links or the first and second longitudinal links can be split so that both split links (minor links) match. For this scenario, the two links must be split in the same way. For instance, as the first and second transverse links can be split resulting in matching split links by splitting the first transverse link at the third pivot axis connecting the split transverse links to the handle and splitting the second transverse link at the sixth pivot axis connecting the split transverse links to the handle. The third scenario is illustrated in FIG. 24. For this scenario, the first and second transverse links 50, 52 from FIG. 4, have both been split into two separate matching links. The first transverse link 50 in FIG. 4 has been split into matching first and third transverse links 950, 953 sharing the third pivot axis 963 shown in FIG. 24 and the second transverse link 52 in FIG. 4 has been split into matching second and fourth transverse links 952, 954 sharing the sixth pivot axis 966 shown in FIG. 24.

Similarly, the first and second longitudinal links can be split per the third scenario by splitting the first longitudinal link at the first pivot axis joining the first longitudinal link to the cartridge carrier and splitting the second longitudinal link at the second pivot axis joining the second longitudinal link to the cartridge carrier. If the matching splits are done in any other way then the mechanism will not be fully constrained. Thus, the third scenario is limited to two embodiments.

Finally, for a fourth scenario it is possible to split either both of the transverse links or both of the longitudinal links in different ways (so that the split links and the corresponding shared axis of the two split links do not match). For this scenario, the split links can share any of the three axes from their respective original links, as long as the axes shared by the two split transverse links or the two split longitudinal links are not matching. For the transverse links the matching pairs of pivot axis are the third and sixth pivot axis 63, 66, the fifth and eighth pivot axes 65, 68, and the fourth and seventh pivot axes 64, 67. For the first and second longitudinal links, the matching pairs of pivot axis are the first and second pivot axis, 60, 62 the fourth and fifth pivot axis 64, 65 and the seventh and eighth pivot axis 67, 68. The fourth scenario can produce twelve different embodiments since there are six possible combinations of non-matching axes for both the transverse and longitudinal links.

Figure 25:
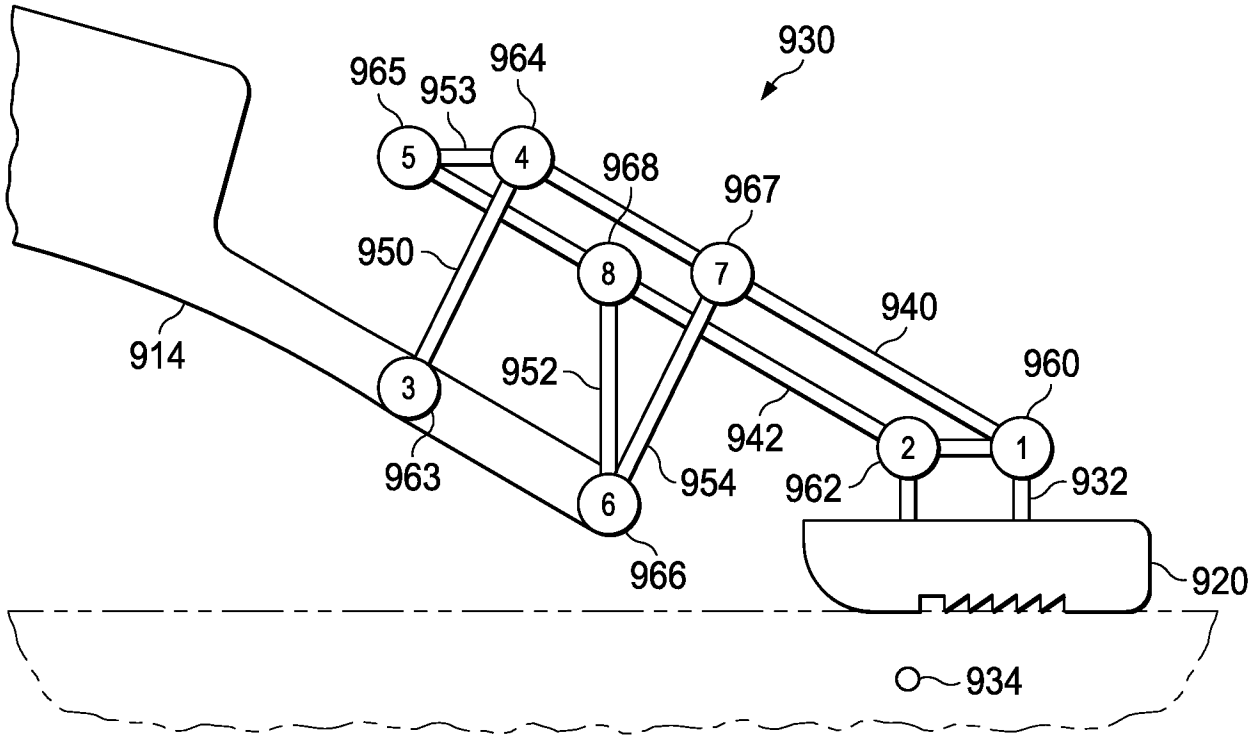
FIG. 25 is an alternate embodiment of the linkage mechanism shown in FIG. 4 incorporating two different split transverse links.

The fourth scenario is illustrated in FIG. 25. As shown, the first transverse link 50 shown in FIG. 4 has been split into two separate links sharing the fourth pivot axis 964 and the second transverse link 952 has been split into two separate links sharing the sixth pivot axis 966. As a result, a third transverse link 953 between the fourth pivot axis 964 and the fifth pivot axis 965 and a fourth transverse link 954 between the seventh pivot axis 967 and the sixth pivot axis 966 has been formed as illustrated in FIG. 25.

Virtual Pivot Axis

As previously described, the linkage mechanism according to the present invention enables the cartridge to rotate about a virtual pivot axis throughout the shaving stroke. The virtual pivot axis is in a region that is forward of the cartridge midpoint and into the skin. The virtual pivot axis region is defined by boundaries illustrated in the graph in FIG. 28. First and second boundaries lie on axes having a common origin located at the cartridge midpoint 8. The axes extend in a +X direction parallel to the cutting plane toward the front edge 11 of the cartridge 20 and in a +Y direction perpendicular to the cutting plane 6 away from the skin 2. The first boundary extends from the cartridge midpoint 8, perpendicular to the cutting plane along the Y axis (X=0) in the −Y direction. The second boundary extends from the cartridge midpoint along a line defined by Y=−0.1X. This virtual pivot axis region defined by first boundary X=0 and second boundary Y=−0.1X is identified as Region I in FIG. 28. A more preferred region is a region having a first boundary extending perpendicular to the cutting pane and forward of the blade array 16 identified as Region II in FIG. 28. More details pertaining to the aforementioned regions as well as other preferred virtual pivot axis regions are fully described below.

Cartridge to Skin Angle as a Function of Pivot Axis Location

Figure 26:
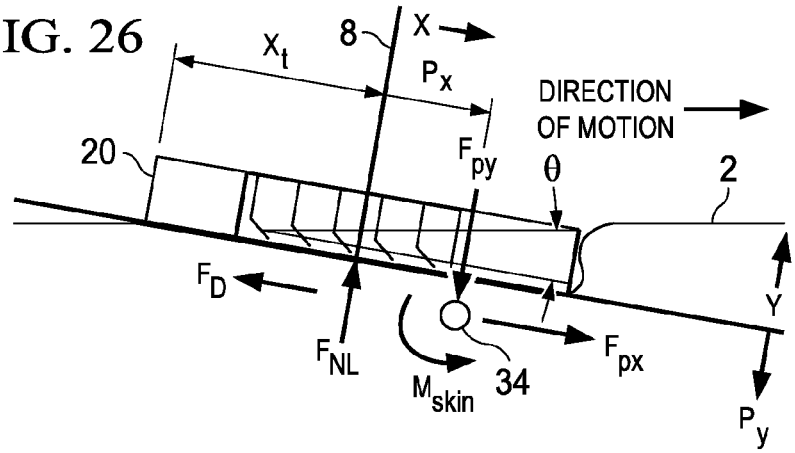
FIG. 26 is an analytical model of a razor cartridge.

Numerical modeling using both the finite element and lumped parameter approach were used to demonstrate that a preferential region exists for placement of the virtual pivot axis location resulting in a flat cartridge to skin angle. The modeling also suggests that the preferential region is strongly dependant on the apparent friction between the cartridge and skin. The reason for this is best described by a simplified analytical model of the forces acting on the cartridge 20 as it is applied to the skin 2. The simplified analytical model is shown in FIG. 26. The apparent friction is determined by dividing the total drag force $F_D$ acting on the cartridge by normal load force $F_{NL}$ which is a reaction to the force $F_{py}$ applied at the cartridge virtual pivot axis 34. An apparatus for measuring loads on a razor cartridge is described in Patent Application Publication US 2008/0168657 A1.

The analytical model in FIG. 26 shows a cartridge 20 pressing into the skin 2 due to a force $F_{py}$ applied at the cartridge virtual pivot axis 34. The skin 2 is assumed to react to force $F_{py}$ with an evenly distributed force acting perpendicular to the cartridge surface. The evenly distributed force is modeled as a resultant normal load force, $F_{NL}$, acting at the midpoint 8 of the cartridge 20.

The cartridge is pulled across the skin with a force, $F_{px}$, applied at the cartridge virtual pivot axis, which is balanced by an equal and opposite drag force $F_D$ between the cartridge 20 and the skin 2. In the analytical model shown in FIG. 26, the cartridge 20 is assumed to have negligible mass and to be moving with a constant velocity. Based on these assumptions, the cartridge 20 presses into the skin 2 and rotates about a cartridge to skin angle θ to reach equilibrium. In order for the cartridge to be in equilibrium, the total moment applied by the skin, $M_{skin}$, to the cartridge must balance the moments resulting from the skin reaction forces $F_{NL}$ and $F_D$. Typically, a cartridge 20 will also have a biasing moment which is not included in this model as it is assumed to be negligible compared to the applied load $F_{px}$.

Force Balance

Forces at the virtual pivot axis equal the cartridge reaction forces.

$F_{NL}=F_{py}$ resolving forces normal to the cartridge shaving plane (1)

$F_D=F_{px}$ resolving forces parallel to the cartridge shaving plane. (2)

Moment Balance

Moment applied to the cartridge by the skin equals the moment applied by the cartridge to the skin.

$$M_{skin}=-F_{NL}P_x-F_DP_y \text{ taken counter clockwise about cartridge virtual pivot axis position.} \quad (3)$$

By inspection, it can be seen that for a cartridge of constant depth, the reaction force of the skin will be a function of the bulk modulus E, the cartridge to skin angle θ and half the length, $X_t$, of the cartridge:

$$M_{skin}=f\{E\theta X_t\} \quad (4)$$

Substituting Equation (4) into Equation (3) and noting that $F_D$ is proportional to the coefficient of friction, μ times $F_{NL}$ results in the following:

$$\theta = f\left\{\frac{-F_{NL}}{EX_t}(P_x + \mu P_y)\right\} \quad (5)$$

Assuming $$\frac{-F_{NL}}{EX_t}$$

is a constant, (i.e. comparing pivot position for a fixed normal load, $F_{NL}$, and constant skin modulus E and cartridge length $X_t$) allows the following to be introduced:

$$A = \frac{-F_{NL}}{EX_t} + \varepsilon \quad (6)$$

Where ϵ is the error in the model due to the simplifying assumptions. Thus, equation (5) becomes:

$$\theta=f\{A(P_x+\mu P_y)\} \quad (7)$$

Tests:

If it is assumed that μ=1, θ=0 representing a flat cartridge to skin angle, then from Equation 7 above the equation must be true:

$$P_y=-P_x \text{ which is a line having gradient } -1 \text{ from the center of the cartridge.} \quad (13)$$

$$\text{which has the solution } P_y=P_x=0 \text{ indicating that the pivot axis is at the center of the cartridge.} \quad (14)$$

$$P_y = \frac{-1}{\mu}P_x \quad (15)$$

which is a line of gradient $$\frac{-1}{\mu}$$

from the cartridge centre.

Figure 27:
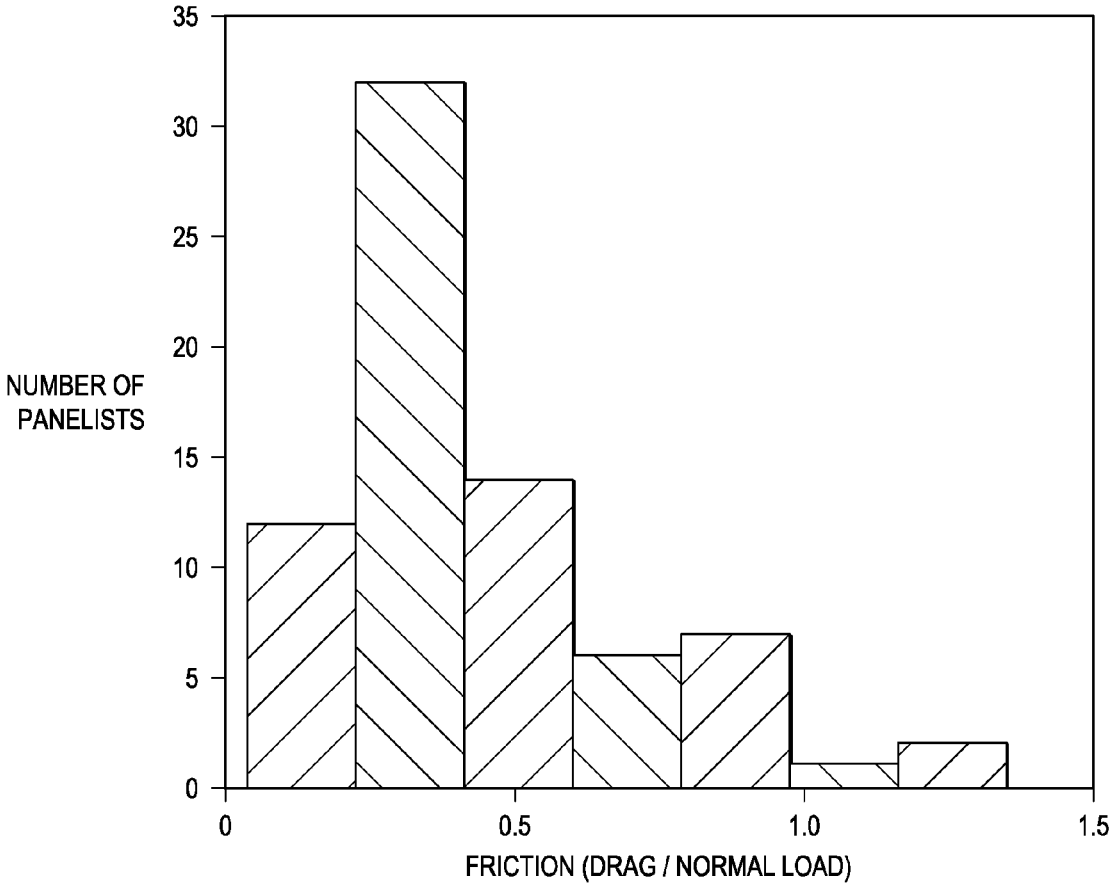
FIG. 27 is a bar chart displaying friction measurements from shave test.

Therefore, it can be shown that the virtual pivot axis location that delivers a flat CTSA is friction dependent. Empirical measurement of friction with a Fusion cartridge across a panel of approximately 80 men was performed using an apparatus for measuring loads on a razor cartridge as described in Patent Application Publication US 2008/0168657 A1. The data from the measurements is provided in the bar chart in FIG. 27. The bar chart shows the values for μ across the whole cartridge ranges between μ=0.1 and 1.4. Substituting these end range values into equation (15) above provides two equations defining first and second boundaries of the more preferred region for the location of the virtual pivot axis. The more preferred virtual pivot axis region is the triangular region identified as Region III in the graph provided in FIG. 28. As shown, Region III is defined by boundaries identified as μ=0.1 and μ=1.4

Based on analysis above, it follows that an improved, flatter CTSA (closer to 0 degrees) can be achieved if the term ($P_y\mu+P_x$) is small or otherwise approaches zero. As a result, the beneficial virtual pivot axis region defining the location of the virtual pivot axis for a forward pivoting system is extended beyond the triangular region described above, where $P_X$ is positive, to any area where $P_y$ is negative and of a similar order of magnitude to $P_X$ e.g. $|P_y|>0.1P_x$ so that it has an appreciable impact on CTSA. An appreciable impact on CTSA is a change of at least 1 degree which is deduced from empirical measurements described below, requires $P_y=0.1P_x$ (or 10% $P_x$). As a result the beneficial virtual pivot axis region is defined by the first boundary extending from the cartridge midpoint, perpendicular to the cutting plane along the Y axis (X=0) in the −Y direction and the second boundary extending from the cartridge midpoint along a line defined by Y=−0.1X.

Empirical Measurements

While the analytical model shown in FIG. 26 illustrates the fundamental force balance which defines the preferred pivot position; the reality of shaving is more complex. Therefore, a set of experiments have been conducted which verify model findings. The Gillette Fusion Proglide razor has been shown to have a cartridge to skin angle of approximately 11 degrees, with its pivot position located approximately 3.7 mm forward of the cartridge midpoint (nominally taken as the position of the middle blade) and 1.2 mm above the cutting plane away from the skin plane. This is identified as location F on the graph in FIG. 29. A pivot axis location further forward of the midpoint of the cartridge and above the skin plane (approximately 6 mm and 3 mm respectively) marked as location 2 on graph in FIG. 29 has been shown to have a cartridge to skin angle of 18 degrees. A pivot axis location 3.7 mm ahead of the cartridge midpoint and −3 mm into the skin identified as location 1 on graph in FIG. 29 has been shown to have a cartridge to skin angle of approximately 0 degrees. Location 3 on the graph in FIG. 29 identifies a pivot axis location at the cartridge midpoint (nominally the middle blade) which is well known in the art to deliver a relatively flat CTSA as shown in U.S. Pat. No. 5,661,907. These measurements summarized in Table I below are consistent with finite element and lumped parameter modeling, and are in line with the conclusions reached above using the simple analytical model.

TABLE I

| Point | Distance Px from Midpoint (mm) | Distance Py from Midpoint (mm) | CTSA α° |
|---|---|---|---|
| F | 3.7 | 1.2 | 11 |
| 1 | 3.7 | −3.0 | 0 |
| 2 | 6.0 | 3.0 | 18 |
| 3 | 0 | 0 | 0 |

Figure 29:
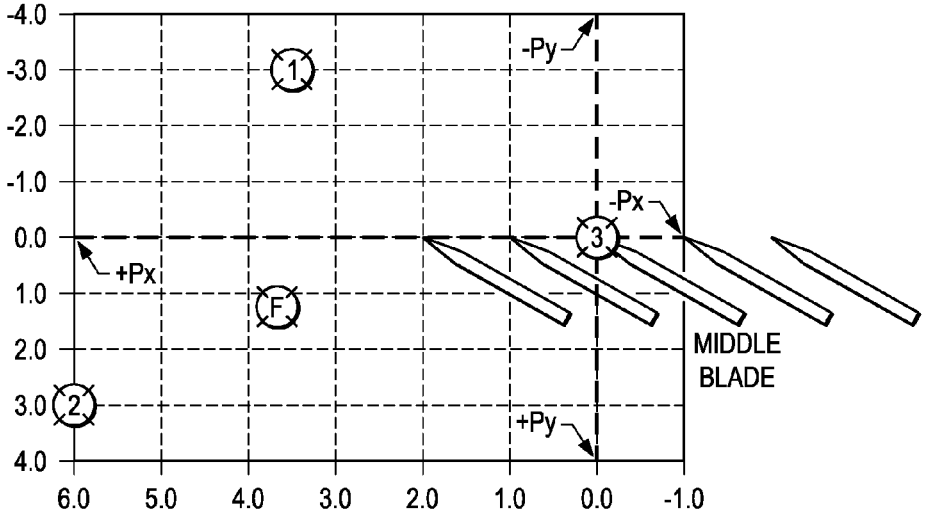
FIG. 29 is a side view of a razor cartridge displaying a variety of virtual pivot axis locations.

Comparing Point 1 and Point F in Table I and the graph in FIG. 29, it can be seen that there is an 11 degree difference in CTSA measurement. Point 1 and Point F lie along the line $P_X$=3.7, with point F at $P_y$=1.2 and point 1 at $P_y$=−3.0. If it is assumed that there is a linear relationship between Py and CTSA along this line, then for a one degree change in CTSA requires a 10% change in the $P_y/P_X$ ratio as detailed in Table II below. Thus, for an into the skin pivot position, $P_y$ should be at least 10% $P_x$ ($P_y$=10% $P_x$) in order to result in an appreciable effect of approximately 1° change in CTSA.

TABLE II

| Px | Py | Py/Px % | CTSA α° | Data Source |
|---|---|---|---|---|
| 3.7 | 1.2 | 32% | 11 | Measurement (Point F) |
| 3.7 | 0.8 | 22% | 10 | Assumed Linear Relationship |
| 3.7 | 0.4 | 12% | 9 | Assumed Linear Relationship |
| 3.7 | 0.1 | 1% | 8 | Assumed Linear Relationship |
| 3.7 | −0.3 | −9% | 7 | Assumed Linear Relationship |
| 3.7 | −0.7 | −19% | 6 | Assumed Linear Relationship |
| 3.7 | −1.1 | −29% | 5 | Assumed Linear Relationship |
| 3.7 | −1.5 | −40% | 4 | Assumed Linear Relationship |
| 3.7 | −1.9 | −50% | 3 | Assumed Linear Relationship |
| 3.7 | −2.2 | −60% | 2 | Assumed Linear Relationship |
| 3.7 | −2.6 | −71% | 1 | Assumed Linear Relationship |
| 3.7 | −3.0 | −81% | 0 | Measurement (Point 1) |

Preferred Pivot Position Regions

While the simple analytical model described above is sufficient to explain the principles and range of the beneficial virtual pivot axis region, more refined models are required to determine an optimal virtual pivot axis location. The preferred embodiment has a virtual pivot axis near the pivot axis location described as location 1 in the graph in FIG. 29 which is 3.7 mm ahead of the cartridge midpoint and −3 mm into the skin. This virtual pivot lies on a line extending through location one which is defined by $P_y=-P_x+0.7$. The line $P_y=-P_x+0.7$ has been derived from lumped parameter modeling and empirical measurements and is shown on the graph in FIG. 28. It has been found that this line gives the best response for a range of friction conditions when second order effects are included in modeling.

The aforementioned analysis has led to the following hierarchy of increasing preferred virtual pivot axis regions for a forward pivoting cartridge to achieve flat or flatter CTSA:

1. Pivot positions which are forward of the blade array are preferred to those simply above the blade array, as this allows the blades to rotate away from contours.
2. For forward pivoting cartridge systems, pivot axis locations which are projected into the skin, below the skin plane, are preferred to those which lie above the skin plane. In order to have a tangible effect, the distance ($P_y$) the pivot axis location is projected into the skin needs to be at least 10% of the distance ($P_X$) the pivot axis location is forward of the cartridge midpoint position.
3. Pivot positions which lie between the zero CTSA lines for low and high friction strokes (μ=0.1 and 1.4, $$P_y = \frac{-1}{0.1}P_x$$

and $$P_y = \frac{-1}{1.4}P_x\Big)$$

are preferred to those outside this region.

Figure 28:
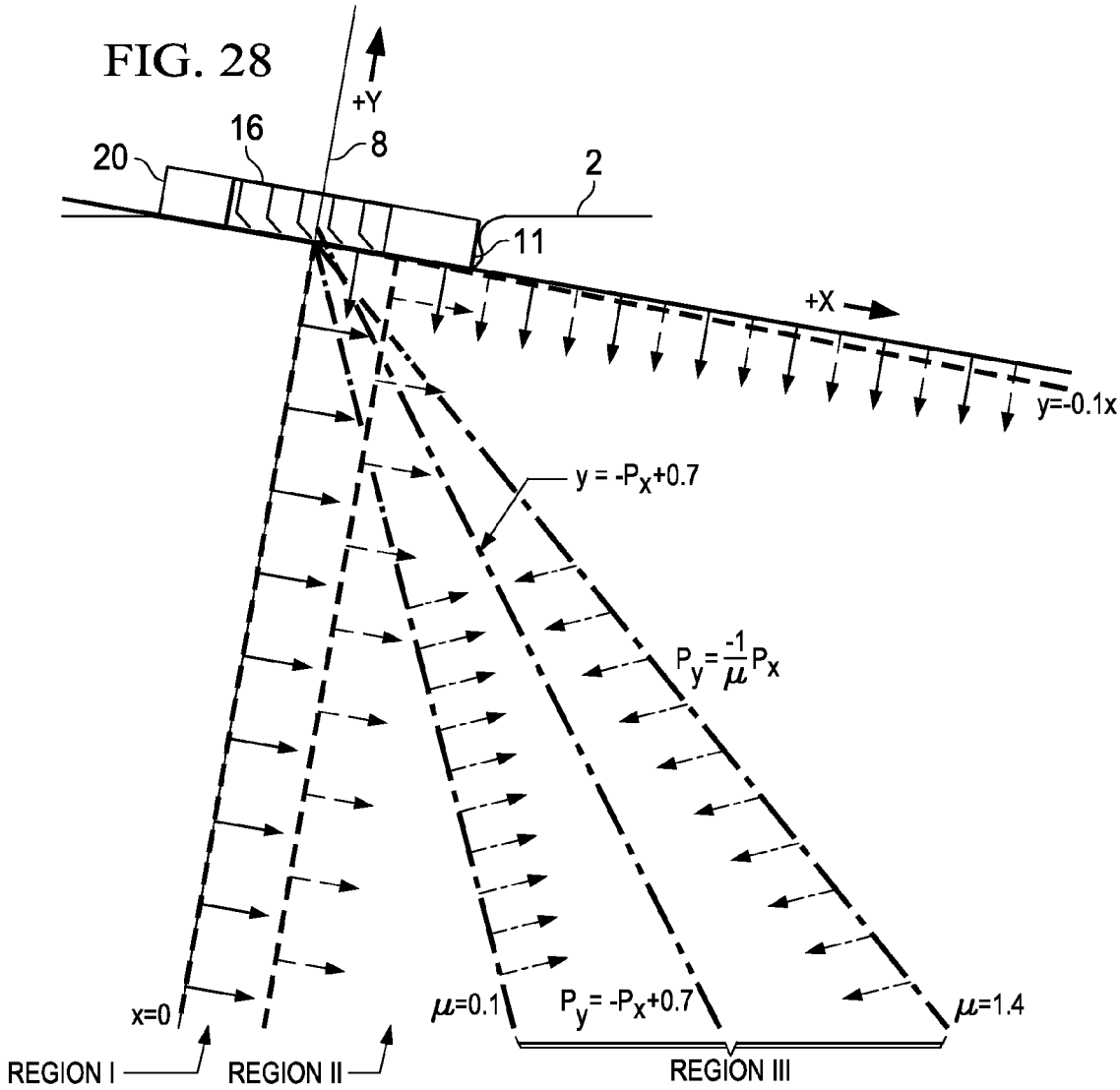
FIG. 28 is a side view of a razor cartridge displaying the virtual pivot axis regions.

4. Pivot axes located in proximity to the location designated as position 1 in the graph in FIG. 29 which lie on the line $P_y=-P_x+0.7$ shown in FIG. 28 representing a zero CTSA are most preferred.

Regarding all numerical ranges disclosed herein, it should be understood that every maximum numerical limitation given throughout this specification includes every lower numerical limitation, as if such lower numerical limitations were expressly written herein. In addition, every minimum numerical limitation given throughout this specification will include every higher numerical limitation, as if such higher numerical limitations were expressly written herein. Further, every numerical range given throughout this specification will include every narrower numerical range that falls within such broader numerical range and will also encompass each individual number within the numerical range, as if such narrower numerical ranges and individual numbers were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A linkage mechanism for a wet shaving razor, the linkage mechanism comprising a first end pivotally connected to a handle about a top side of said handle, and a second end pivotally connected to a cartridge carrier for removably attaching and rocking a razor cartridge about a virtual pivot axis, the linkage mechanism further comprising:

a. a first longitudinal link having a first end and a second end opposite the first end, a first pivot axis proximate the first longitudinal link first end pivotally attaching the first longitudinal link first end to the cartridge carrier;

b. a second longitudinal link having a first end and a second end opposite the first end, a second pivot axis proximate the second longitudinal link first end pivotally attaching the second longitudinal link first end to the cartridge carrier wherein the second pivot axis is spaced apart from the first pivot axis by a first distance;

c. a first transverse link having a first end and a second end opposite the first end wherein the first transverse link first end is pivotally attached to the handle at a third pivot axis and the first transverse link second end is pivotally attached to the first longitudinal link second end at a fourth pivot axis wherein the distance between the fourth pivot axis and the third pivot axis is a third distance;

d. a second transverse link having a first end and a second end opposite the first end, wherein the second transverse link first end is pivotally attached to the handle at a sixth pivot axis and the second transverse link second end is pivotally attached to the second longitudinal link at an eighth pivot axis, wherein the distance between the eighth pivot axis and the sixth pivot axis is a seventh distance;

e. a third transverse link having a first end and a second end, wherein the third transverse link first end is pivotally attached to the handle at the third pivot axis opposite the first transverse link first end, the third transverse link second end is pivotally attached to the second longitudinal link second side at the fifth pivot axis, wherein the fifth pivot axis is separated from the fourth pivot axis by a second distance equal to the first distance and the fifth pivot axis is separated from the third pivot axis by fourth distance equal to the seventh distance; and f. a fourth transverse link having a first end and a second end, wherein the fourth transverse link first end is pivotally attached to the handle at the sixth pivot axis opposite the second transverse link first end, the fourth transverse link second end is pivotally attached to the first longitudinal link second side at an seventh pivot axis, wherein the seventh pivot axis is separated from the eighth pivot axis by a fifth distance equal to the first distance and the seventh pivot axis is separated from the sixth pivot axis by a sixth distance equal to the third distance;

wherein the virtual axis is separated from the first pivot axis by an eighth distance equal to the third distance and is separated from the second pivot axis by ninth distance equal to the fourth distance.

2. A linkage mechanism for a wet shaving razor according to claim 1, wherein the second transverse link second end is pivotally attached to the first longitudinal link first side at the seventh pivot axis, and wherein the fourth transverse link second end is pivotally attached to the second longitudinal link second side at the eighth pivot axis.

3. A linkage mechanism for a wet shaving razor according to claim 2 wherein the fourth pivot axis and the seventh pivot axis are disposed at the first longitudinal link second end equidistant from the first pivot axis on the first longitudinal link first end and the fifth pivot axis and eighth pivot axis are disposed on the second longitudinal link second end equidistant from the second pivot axis on the second longitudinal link first end.

* * * * *